US009297166B2

(12) United States Patent
Carbines

(10) Patent No.: US 9,297,166 B2
(45) Date of Patent: Mar. 29, 2016

(54) FIXING SYSTEM FOR CLADDING AND A CLADDED STRUCTURE

(75) Inventor: Richard James Carbines, Auckland (NZ)

(73) Assignee: Jenkin Timber Limited, Auckland (NZ)

( * ) Notice: Subject to any disclaimer, the term of this patent is extended or adjusted under 35 U.S.C. 154(b) by 0 days.

(21) Appl. No.: 13/458,636

(22) Filed: Apr. 27, 2012

(65) Prior Publication Data

US 2012/0272603 A1 Nov. 1, 2012

(30) Foreign Application Priority Data

Apr. 29, 2011 (NZ) ..... 592576

(51) Int. Cl.
*E04F 13/08* (2006.01)
*E04F 13/26* (2006.01)

(52) U.S. Cl.
CPC ..... *E04F 13/0803* (2013.01); *E04F 13/0812* (2013.01); *E04F 13/0819* (2013.01); *E04F 13/0864* (2013.01); *E04F 13/0892* (2013.01)

(58) Field of Classification Search
CPC . E04F 13/0803; E04F 13/0812; E04F 13/081; E04F 13/0819; E04F 13/0821; E04F 13/0864; E04F 13/0892
USPC ..... 52/474, 475.1, 478, 482, 483.1, 489.1, 52/543, 544, 545, 546, 547, 550, 551, 552, 52/553, 560, 387, 476, 506.05, 506.06, 52/510
See application file for complete search history.

(56) References Cited

U.S. PATENT DOCUMENTS 682,316 A * 9/1901 Caldwell ..... 52/356
1,004,859 A * 10/1911 Dowd ..... 52/349
1,973,795 A * 9/1934 Copper, Jr. et al. ..... 52/475.1
2,354,639 A * 7/1944 Seymour ..... 52/543
3,261,136 A * 7/1966 Abner et al. ..... 52/471
4,096,679 A * 6/1978 Naz ..... E04F 13/0864 52/523
4,111,188 A * 9/1978 Murphy, Jr. ..... 126/622
4,698,942 A * 10/1987 Swartz ..... 52/99
4,961,295 A * 10/1990 Kosch et al. ..... 52/36.5
5,029,425 A 7/1991 Bogataj (Continued)

FOREIGN PATENT DOCUMENTS

DK EP 1443160 A1 * 8/2004 ..... E04F 13/0864
GB 2 155 970 A 10/1985

(Continued)

*Primary Examiner* — Charles A Fox
*Assistant Examiner* — Joseph J Sadlon
(74) *Attorney, Agent, or Firm* — Frommer Lawrence + Haug LLP

(57) ABSTRACT

A cladded structure having rows of spaced-apart fixing devices with engagement members mounted to the support structure for supporting rows of partially overlapping cladding boards. Each row of cladding boards being supported by a respective row of fixing devices. Each cladding board having a recess being provided in and along its rear surface into which the engagement members of the fixing devices engage to support the cladding board on the support structure. Retaining gaps are formed between sections of the upper surface of each cladding board and protruding surfaces of the fixing devices supporting the next upper adjacent cladding board, and a plurality of resiliently deformable retaining components are located in a deformed state in at least one retaining gap associated with each cladding board to exert a downward force on the cladding boards to retain them in an engaged state with their fixing devices.

32 Claims, 18 Drawing Sheets

(56) References Cited

U.S. PATENT DOCUMENTS 5,056,288 A * 10/1991 Funaki ..... E04D 3/362 52/520
5,249,402 A * 10/1993 Crick ..... E04F 13/18 52/520
5,398,473 A * 3/1995 Chan ..... 52/506.06
5,692,352 A * 12/1997 Simpson ..... 52/545
6,044,609 A * 4/2000 Kim ..... 52/551
6,199,328 B1 * 3/2001 McGrath et al. ..... 52/127.1
6,226,947 B1 * 5/2001 Bado et al. ..... 52/483.1
6,830,405 B2 * 12/2004 Watanabe ..... E04F 13/0826 403/11
6,895,721 B2 * 5/2005 Watanabe ..... E04F 13/0816 52/476
6,928,781 B2 * 8/2005 Desbois ..... E04D 12/006 52/535
7,810,288 B2 * 10/2010 Lechasseur ..... 52/235
2003/0182888 A1 * 10/2003 Desbois ..... E04D 12/006 52/551
2004/0139675 A1 * 7/2004 Watanabe ..... 52/518
2012/0292474 A1 * 11/2012 Desch nes ..... 248/309.1

FOREIGN PATENT DOCUMENTS

GB 2155970 A * 10/1985 ..... E04F 13/14
WO WO 2008/030114 A 3/2008

* cited by examiner

FIGURE 10a
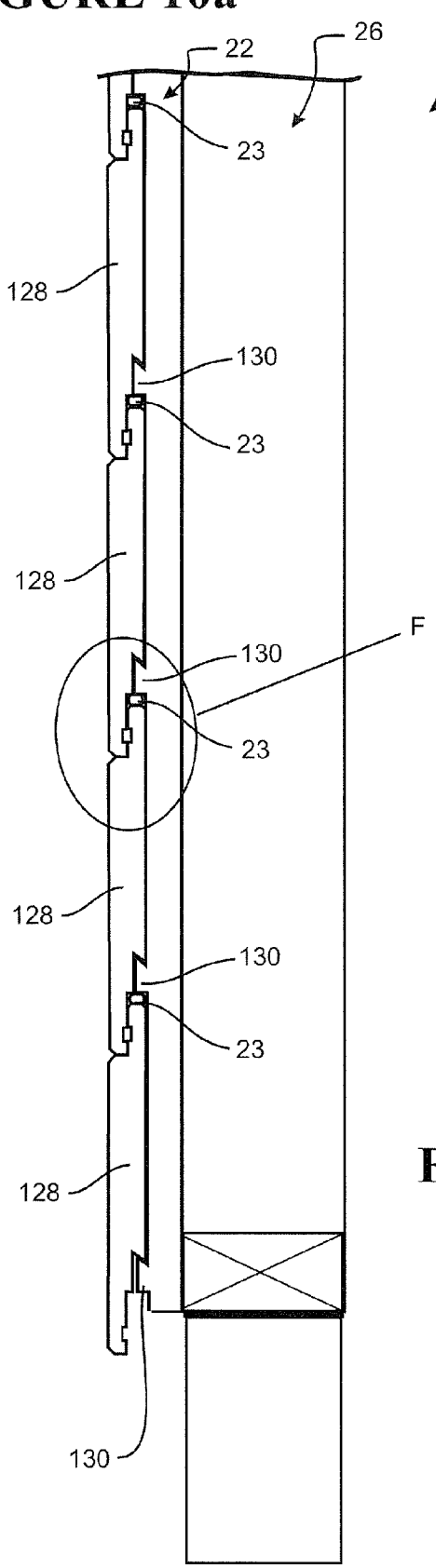
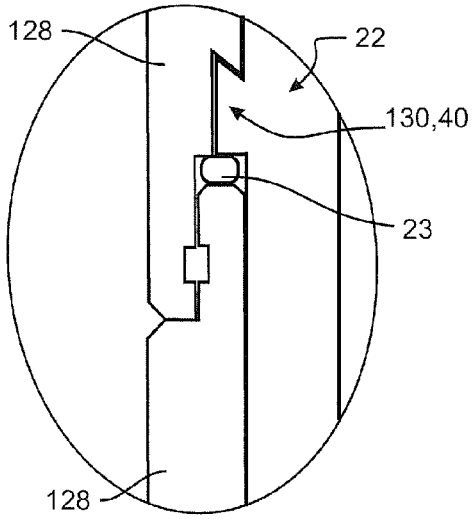
FIGURE 10b
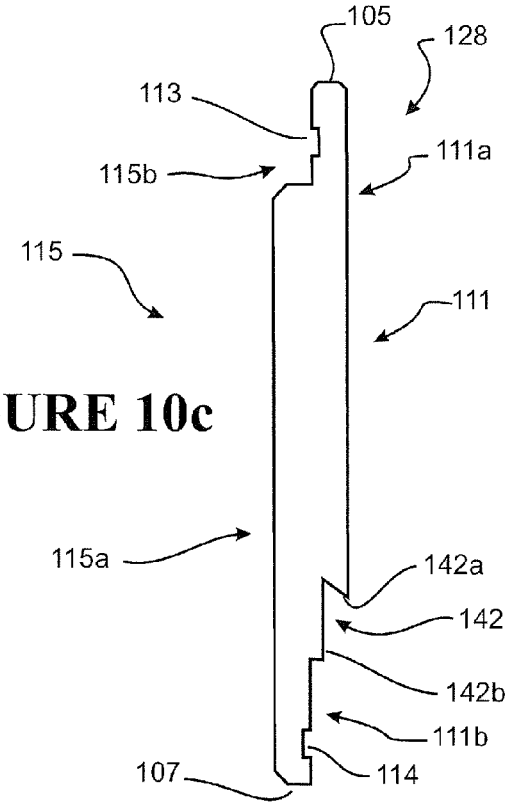
FIGURE 10c

FIGURE 11a
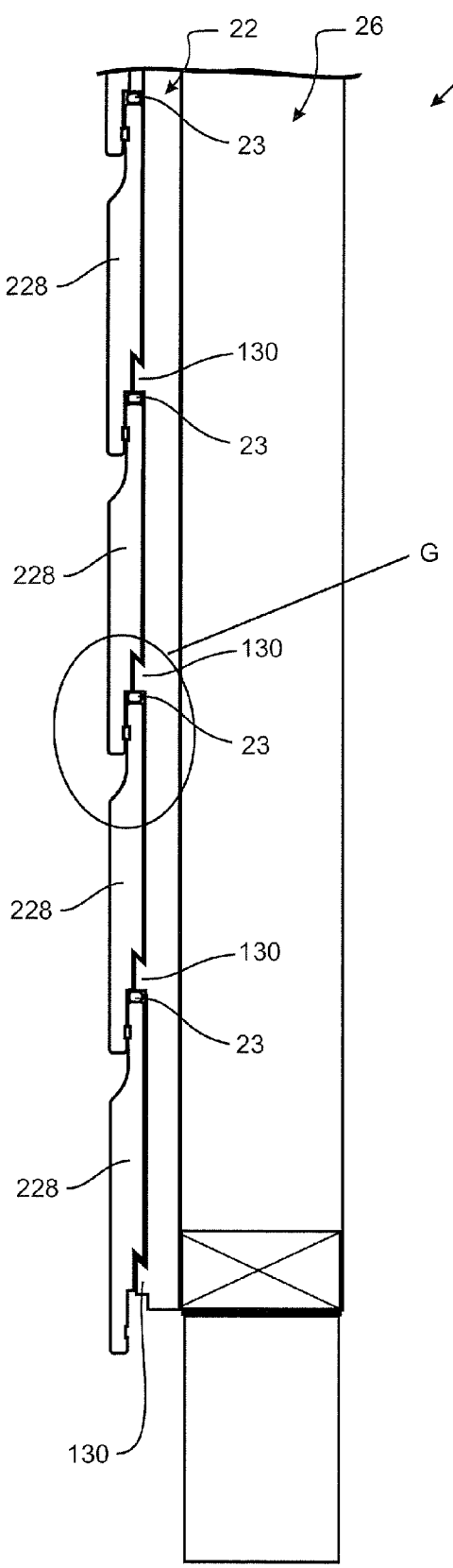
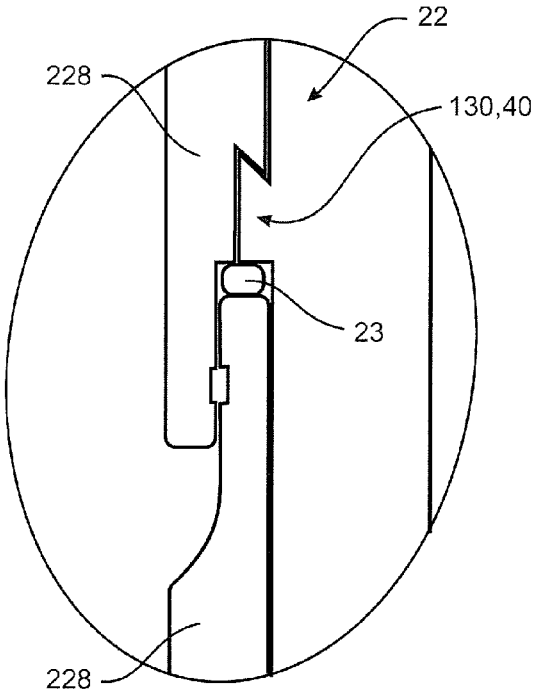
FIGURE 11b
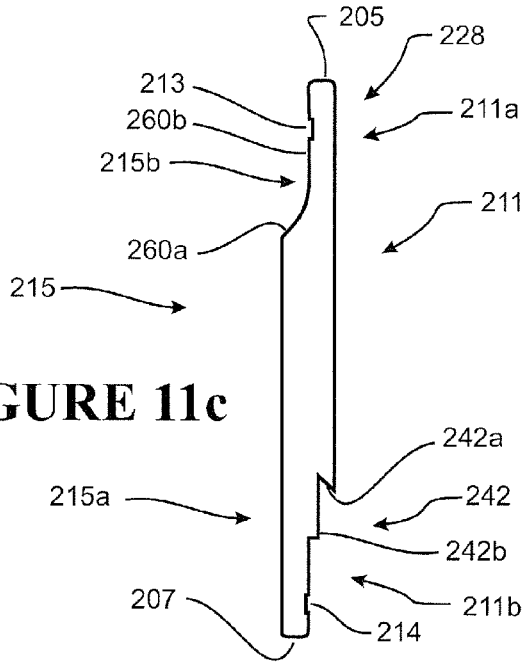
FIGURE 11c

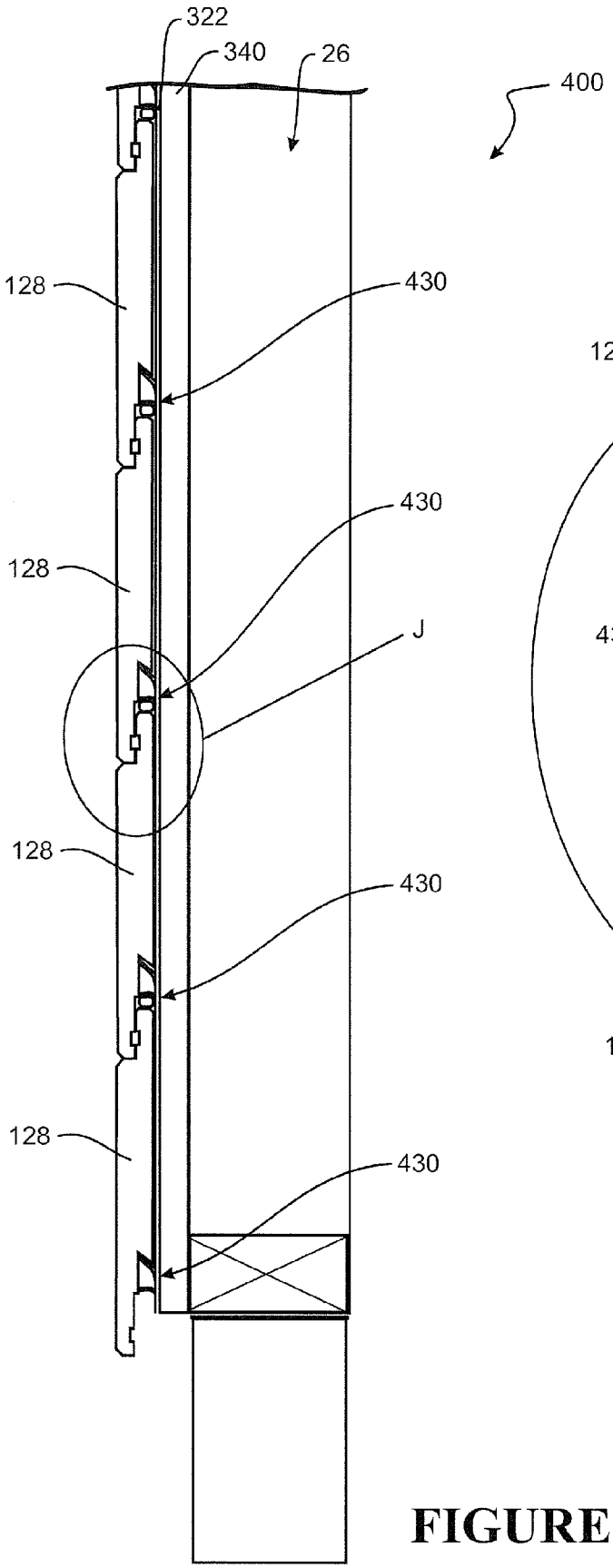
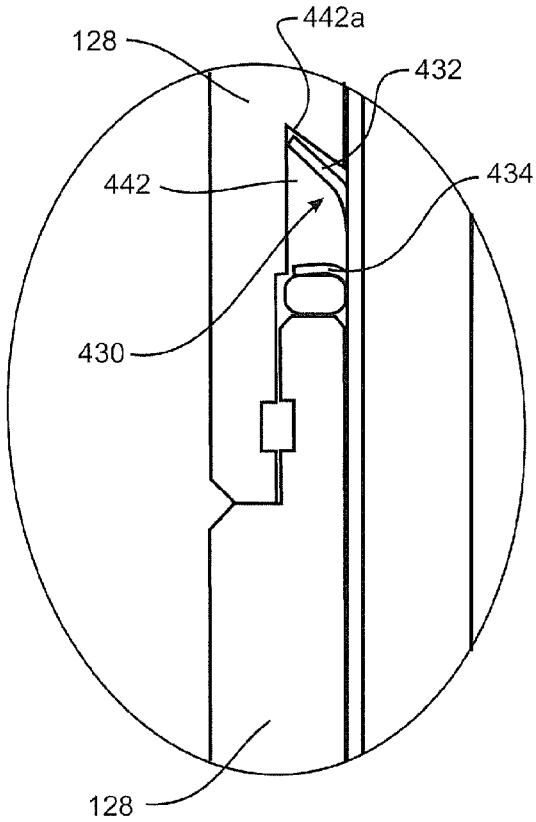
FIGURE 13b
FIGURE 13a

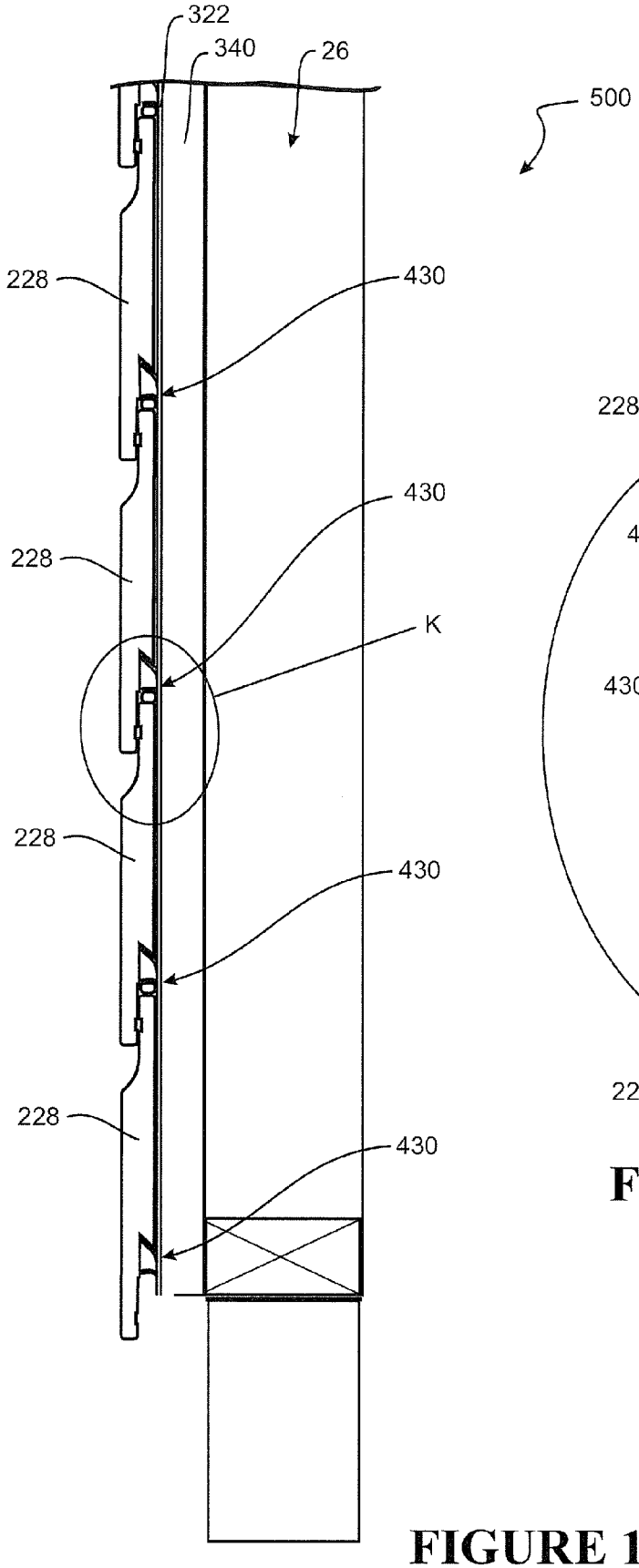
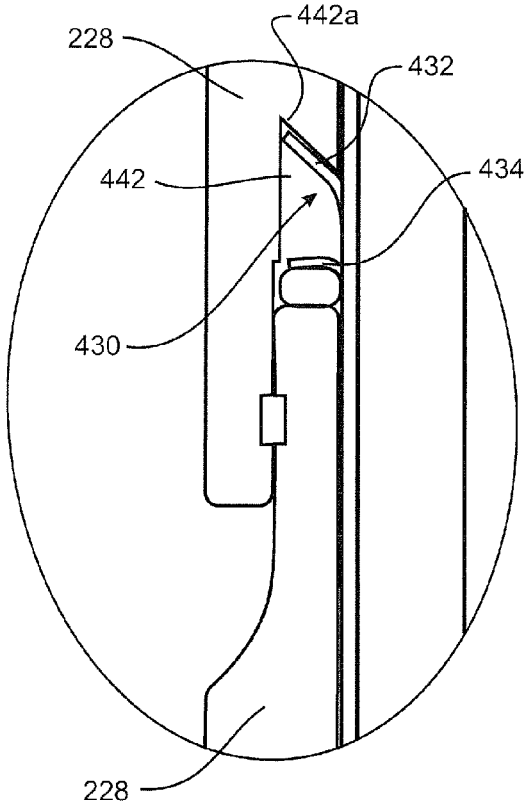
FIGURE 14b
FIGURE 14a

FIXING SYSTEM FOR CLADDING AND A CLADDED STRUCTURE

FIELD OF THE INVENTION

The present invention relates to a fixing system for cladding and an associated cladded structure. In particular, although not exclusively, the fixing system may be utilised to secure weatherboards to the walls or framing of buildings to form a cladded structure. The fixing system also has applications in relation to cladding other structures, such as fences, screens, and roofs.

BACKGROUND TO THE INVENTION

There are numerous weatherboard designs on the market for cladding. The most important feature of a weatherboard design is its cross-sectional profile. This profile dictates the way in which the weatherboards should be installed and the overall appearance of the weatherboard cladding after installation. Commonly, weatherboards are designed to be installed in an overlapping relationship with each other and can be fixed horizontally, vertically or on an angle. Further, some weatherboard designs include grooves that, when installed, cooperate with the grooves of overlapping weatherboards to provide anti-capillary channels. Such channels prevent moisture from getting in behind the weatherboards and causing damage.

FIGS. 1 and 2 show cross-sectional and front views respectively of a known weatherboard design 10 that is defined along its length by front 15 and rear 11 surfaces that extend between upper 5 and lower 7 surfaces. The rear surface 11 of the weatherboard 10 has a sloped portion 12 that is arranged to abut the framing 16 of a building when installed and this enables like weatherboards to be installed in a partially overlapping relationship with each other as shown in FIG. 3. Weatherboards having this design are also provided with wide grooves 13 and 14 along the front 15 and rear 11 surfaces respectively. When such weatherboard cladding is installed, the grooves 13,14 of each weatherboard cooperate with the grooves of overlapping weatherboards to create anti-capillary channels 17 shown in FIG. 3.

During one common installation method, the weatherboards shown in FIGS. 1-3 are fixed to the framing 16 with nails 9 one at a time from the bottom up such that the weatherboards are parallel and have an even overlap up the framing. The heads of the fixing nails 9 are visible on the front surfaces 15 of the weatherboards. In the finished installation, the nails are generally punched below the surface, then filled, sanded and over painted. One method of aligning the weatherboards is to ascertain the required level and then rest the next weatherboard to be installed on a line of nails partially nailed in, which are removed once the weatherboard has been nailed into place, and this leaves another set of nail holes to be filled, sanded and over painted.

Referring to FIG. 4, it has become increasingly common for cavity battens 19 to be provided between the framing 16 and weatherboards 10. The battens 19 create cavities between the framing 16 or wall of the building and the weatherboards 10 and these cavities provide a drainage path for water and/or moisture that may penetrate in behind the weatherboards. The use of cavity battens is particularly desirable in coastal properties or buildings that are situated in exposed areas that have harsh weather conditions. The cavity battens are used to form drainage channels and the increased drainage allowed by the cavities reduces the likelihood of water or moisture penetrating the framing cavity, the cause of rotting and decay of the internal structure and interior lining.

In the applicant's co-pending international PCT patent application publication WO2008/030114, the contents of which is herein incorporated by reference, a concealed fixing system for cladding is described. In this concealed fixing system, the rows of weatherboards are held in place on the framing by rows of fixing devices that are each arranged to engage into a section of a recess provided along the rear face of each board. Additionally, nails are punched through the weatherboards in the overlapping region of adjacent weatherboards for additional securement of the boards to the framing.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an alternative fixing system for cladding, and/or an associated cladded structure.

SUMMARY OF THE INVENTION

In a first aspect, the present invention broadly consists in a cladded structure comprising:

- a support structure for cladding;
- rows of spaced-apart fixing devices mounted to the support structure, the fixing devices comprising engagement members for engaging with and supporting cladding boards;
- rows of partially overlapping cladding boards covering the support structure with each row of cladding boards being supported by a respective row of fixing devices, each cladding board being defined along the length of the board by front and rear surfaces that extend between upper and lower surfaces, and a recess being provided in and along the rear surface into which the engagement members of a number of fixing devices of a row engage to support the cladding board on the support structure, and wherein retaining gaps are formed between sections of the upper surface of each cladding board and protruding surfaces of or associated with the row of fixing devices supporting the next upper adjacent cladding board; and
- a plurality of resiliently deformable retaining components being located in a deformed state in at least one retaining gap associated with each cladding board such that the retaining components act to exert a downward force on the upper surface of their respective cladding boards to retain them in an engaged state with their respective rows of fixing devices.

In one form, the protruding surfaces forming the retaining gaps are a portion of part of the fixing devices, for example a lower portion or lower surface of each fixing device. In one embodiment, the protruding surfaces are integral with their respective fixing devices.

In another form, the protruding surfaces are separate but associated components to the fixing devices, each protruding surface extending outwardly relative to the support structure below its associated fixing device. For example, each protruding device may be displaced from and/or non-integral with its respective fixing device.

In one form, the retaining components may be material-type retaining components that are members or bodies formed from a material that is resiliently compressible. Preferably, the retaining components are formed from rubber or any other substantially hard but resiliently deformable material, including but not limited to silicone and plastic polymers. The retaining components may have a cross-sectional shape that substantially conforms to the overall cross-sectional shape of the retaining gap when viewed in the direction of the longitudinally extending cladding boards. Alternatively, the cross-sectional shape of the retaining components may be any other suitable shape, whether conforming or non-conforming to the retaining gap, including, but not limited to, square, rectangular, circular, hexagonal, or trapezoidal. The retaining components may be elongate and formed from material that is resiliently extendible in length relative to the longitudinal axis of the member such that the average cross-sectional area of the member transverse to the longitudinal axis reduces in size when the member is stretched or extended in length, and which reverts to its original size when at rest with no extension force or pressure applied.

In an alternative form, the retaining components may be mechanical-type retaining component in which the mechanical structure of the component is configured or arranged to provide resilient deformability. Preferably, the mechanical-type retaining component is in the form of a springy assembly or component comprising upper and lower surfaces that are resiliently compressible from a rest state to a deformed state in which the lower and upper surfaces are closer together than in the rest state, and which is biased toward the rest state. In one example, the mechanical-type retaining components are formed from a shaped or bent plate or piece of material having one or more bends, such as metal, to form a resiliently springing component. In another example, the mechanical-type retaining components are formed from upper and lower plates that are joined together by a spring member, such as a coiled spring.

Preferably, at least a portion of each retaining component is oversized relative to its retaining gap such that the retaining component is deformed when located within its retaining gap. For example, the size of the retaining component is larger than that of the retaining gap in at least one dimension or direction corresponding to the height of the retaining gap.

The retaining components may be elongate components having a length that is substantially equal to the width of their associated retaining gaps in the direction of the longitudinally extending installed cladding boards. Alternatively, the retaining components may have a length substantially smaller than the width of their associated retaining gaps or a length that is larger than the width of their associated retaining gaps.

The retaining components may have a uniform cross-sectional shape along their length, or alternatively in other forms may have a non-uniform cross-sectional shape along their length.

In one form, each retaining gap that is occupied comprises a single retaining component, but in alternative forms a plurality of retaining components may be provided in each occupied retaining gap or a selection of retaining gaps.

In one form, the fixing devices may be provided in integral strips that are secured to the support structure, each strip being provided with a number of integral fixing devices uniformly spaced apart along its length. In one embodiment, the protruding surfaces forming the retaining gaps are separate formations to each respective fixing device, each protruding surface being an integral part of a strip and extending outwardly relative to the strip below its respective fixing device.

In another form, the fixing devices may be individually mounted directly to the support structure in a spaced apart arrangement vertically and horizontally with respect to each other on the support structure to form the rows of fixing devices on the support structure for supporting rows of cladding boards.

In yet another form, the fixing devices may be provided on battens that are secured to the support structure, each batten being provided with a number of fixing devices uniformly spaced apart along its length.

Preferably, the engagement members of the fixing devices are configured to engage into the recess in a rear surface of a respective cladding board in a hook-type engagement relationship such that the cladding boards hang from their respective row of fixing devices.

In one form, the engagement members of the fixing devices comprise a seat surface upon which a complementary engagement surface within the recess of a respective cladding board sits. Preferably, the seat surfaces of the engagement members of the fixing devices are angled upwardly relatively to the horizontal.

In one form, each fixing device may have an engagement member that is in the form of an engagement formation that is shaped to provide the seat surface upon which the complementary engagement surface within the recess of a respective cladding board sits. In one embodiment, each fixing device comprises a wedge-shaped body having a wedge-shaped cross-sectional profile defined by a base end from which a rear face and an front face extend, the front face being angled relative to the rear face such that the front and rear faces meet to form a pointed top-end opposite the base end and wherein the engagement formation protrudes from the front face of the wedge-shaped body at or toward the base end of the wedge-shaped body.

In another form, each fixing device may have an engagement member that comprises an engagement tab that is angled upwardly relative to the horizontal and configured to engage with the recess of a respective cladding board, and wherein the engagement tab comprises the seat surface upon which the complementary engagement surface within the recess of a respective cladding board sits. In one embodiment, the fixing devices are provided in fixing strips that are secured to the support structure, each fixing strip being an elongate strip of material defined by a front face and a rear face extending between a top end and bottom end and comprising a series of integral fixing devices spaced apart along the length of the fixing strip, each fixing device comprising an engagement tab that is a substantially flat portion of material punched from the strip and which is adjoined to the strip at an intact edge of the tab, the engagement tab being bent about a bending edge so as to extend at an acute angle relative to the front face of the strip for engaging with the complementary recess of a cladding board. Additionally, each fixing device may further comprise a lower tab situated below its associated engagement tab relative to the top end of the fixing strip, the lower tab being a substantially flat portioned material punched from the strip and which is adjoined to the strip at an intact bending edge of the tab, the lower tab being bent about the bending edge so as to extend at a predetermined angle relative to the front face of the strip and being provided as the protruding surface for forming the retaining gap associated with the fixing device.

In yet another form, each fixing device may have an engagement member comprising a bracket-type component having an engagement portion that provides the seat surface on which the complementary engagement surface within the recess of a respective cladding board sits. In one embodiment, the fixing devices are provided in fixing strips that are secured to the support structure, each fixing strip being an elongate strip of material defined by a front face and a rear face extending between a top end and bottom end and comprising a series of integral fixing devices spaced apart along the length of the strip, each bracket-type component of the fixing device comprising a substantially L-shaped cross-sectional profile formed by a base portion that as arranged to extend outwardly relative to the surface of the strip and an engagement portion that extends upwardly from the base portion and which terminates with a hooked-end edge that bends back toward the strip to provide the seat surface.

Preferably, the recess of each cladding board may comprise an inclined upper engagement surface extending into the board from the rear surface and which sits upon complementary angled seat surfaces provided by the engagement members of its respective fixing devices. More preferably, the recess of each cladding board has a cross-sectional profile comprising: an inclined upper engagement surface extending upwardly into the board from the rear surface of a board, a back surface extending downwardly from the inclined upper surface, and a lower surface extending back to the rear surface of the board from a back surface of the recess.

The first aspect of the invention may have any one or more features mentioned in respect of the second or third aspects of the invention.

In a second aspect, the present invention broadly consists in a fixing system for securing cladding boards to a support structure in a partially overlapping relationship, each cladding board defined along its length by front and rear surfaces that extend between upper and lower surfaces, and a recess being provided in and along the rear face, the fixing system comprising:

a plurality of fixing devices that are mountable to the support structure in a spaced-apart relationship and being aligned into rows, each row of fixing devices being arranged to support a cladding board or row of cladding boards and each fixing device having an engagement member that is arranged to engage with a section of the recess of a cladding board to, in co-operation with a number of other fixing devices of that row also engaging with a section of the recess, support the cladding board in place on the support structure, the rows of fixing devices being spaced-apart by a distance that provides retaining gaps between sections of the upper surface of each supported cladding board and protruding surfaces of or associated with the row of fixing devices supporting the next upper adjacent board; and a plurality of resiliently deformable retaining components, each retaining component being insertable in a deformed state into at least one of the retaining gaps associated with each supported cladding board such that the inserted retaining components exert a downward force on the upper surface of their respective cladding boards to retain them in an engaged state with their respective rows of fixing devices.

In one form, the retaining components may be material-type retaining components that are members or bodies formed from a material that is resiliently compressible. Preferably, the retaining components are formed from rubber or any other substantially hard but resiliently deformable material, including but not limited to silicone and plastic polymers.

In an alternative form, the retaining components may be mechanical-type retaining components in which the mechanical structure of the component is configured or arranged to provide resilient deformability Preferably, at least a portion of each retaining component is oversized relative to its respective retaining gap such that the retaining component is deformed when located within its retaining gap. For example, the size of the retaining component is larger than that of the retaining gap in at least one dimension or direction corresponding to the height of the retaining gap.

In one embodiment, the fixing devices are provided in integral strips that are securable to the support structure for receiving the boards, each strip being provided with a number of integral fixing devices spaced apart along its length, the fixing devices being spaced apart along the length of the strips by a uniform predetermined spacing distance. Preferably, the predetermined spacing distance is calculated based on the height of the cladding boards between their upper and lower surfaces and a uniform desired board overlap distance so a to provide retaining gaps of a shape and/or size that will receive and retain the retaining components in a deformed state. In one form of the strip, the protruding surfaces forming the retaining gaps are a portion of part of the fixing devices, for example a lower portion or lower surface of each fixing device. In another form, the protruding surfaces are separate but associated components to the fixing devices, each protruding surface being an integral part of the strip and extending outwardly relative to the strip below its associated fixing device.

In another embodiment, the fixing devices are individually mountable directly to the support structure in a spaced apart arrangement vertically and horizontally with respect to each other on the support structure to form rows of fixing devices on the support structure for supporting the rows of boards. Preferably, the rows of fixing devices may be spaced-apart vertically by a predetermined spacing distance as described above.

In yet another embodiment, the fixing devices are provided on battens that are securable to the support structure for receiving the rows of boards, each batten being provided with a number of fixing devices uniformly spaced apart along its length, and the battens being spaced apart and aligned on the support structure in a vertical orientation relative to each other to provide rows of fixing devices on the support structure for supporting rows of boards. Preferably, the fixing devices are spaced-apart along the batten by a predetermined spacing distance as described above. In one form, the fixing devices are integrally formed with the battens. In another form, the fixing devices are individually attached directly to the battens. In yet another form, the fixing devices are integrally formed in integral strips that are fixed to the battens.

Preferably, the engagement members of the fixing devices are shaped to engage or co-operate with a complementary recess in the rear face of the boards to thereby act to, in co-operation with a number of other fixing devices of that row also engaging with the recess, support and/or the cladding board in place on the support structure, at least against gravity.

It will be appreciated that the relationship between the engagement member of the fixing devices and complimentary recess in the rear face of the cladding boards may be any configuration or relationship that supports, holds or retains the cladding board on the fixing device. In one form, the engagement members of the fixing devices may form hook-type components or surfaces that engage into the recesses of the cladding boards such that the boards hang from the fixing devices. For example, the engagement members may provide a seat surface upon which a complementary engagement surface within the recess of the cladding board may rest or sit. Preferably, the seat surface is angled upwardly relative to the horizontal, in use. In an alternative form, the engagement members of the fixing devices may be shaped and/or sized to have a friction-fit hold with the recesses of the cladding boards.

In one form of the fixing devices, each fixing device has an engagement member that is in the form of or comprises an engagement formation that is shaped and/or configured to engage with the recess of the cladding board. Each engagement formation may provide or comprise a seat surface upon which a complementary engagement surface within the recess of the cladding board may rest or sit. Preferably, the seat surface is angled upwardly relative to the horizontal, in use. In one example of this form of fixing device, the engagement formations are protrusions that extend from the surface of material forming a fixing strip or batten as described above. The engagement formations may be integrally formed from the material itself, which may for example be wood or any other suitable material. By way of example, the fixing devices may have a wedge-shaped body formed in the surface of material forming the fixing strip or batten and the engagement formations are provided at or toward an end portion of the wedge-shaped body. For example, each fixing device may have a substantially wedge-shaped cross-sectional profile formed by a base end from which a rear face and a front face extend, the front face being angled relative to the rear face such that the front and rear faces meet to form a pointed top-end opposite the base end and wherein the front face is designed to abut a rear face of the cladding board and has the engagement formation that protrudes from the front face at or toward the base end for engaging with a recess in the rear surface of the cladding board. The engagement formation of the fixing device may comprise an inclined seat surface that extends from the front face of the underlying wedge-shaped formation of the fixing device, the recess of the cladding boards having a complementary angled engagement surface for sitting or resting on the seat surface in a hook-like engagement relationship to enable the boards to be supported on the support structure by the fixing devices. In another example of this form of fixing device, the engagement formations may protrude directly from the surface of the material of the fixing strip or batten without an underlying wedge shaped body.

In another form of the fixing devices, each fixing device has an engagement member that is in the form of or comprises an engagement tab that is shaped and/or configured to engage with the recess of the cladding board. Each engagement tab may provide a seat surface upon which a complementary engagement surface within the recess of the cladding board may rest or sit in a holding relationship. Preferably, the engagement tab is angled upwardly relative to the horizontal, in use. In one example of this form of fixing device, the engagement tabs extend from the surface of material forming a fixing strip or batten as described above. The engagement tab may be integrally formed from the material itself, which may for example be metal, steel, aluminium or any other suitable material. The fixing devices may be provided in a fixing strip or batten, the fixing strip or batten being an elongate strip of material defined by a front face and a rear face extending between a top end and bottom end and comprising a series of integral fixing devices spaced apart along the length of the strip, each fixing device comprising an engagement tab that is a substantially flat portion of material punched from the strip and which is adjoined to the strip at an intact edge of the tab, the engagement tab being bent about a bending edge so as to extend at an acute angle relative to the front face of the strip for engaging with the complementary recess of a cladding board in a holding relationship. Optionally, each fixing device may further comprise a lower tab situated below its associated engagement tab relative to the top end of the strip. Preferably, the lower tab is a substantially flat portion of material punched from the strip and which is adjoined to the strip at an intact bending edge of the tab, the lower tab being bent about the bending edge so as to extend at a predetermined angle relative to the front face of the strip. The lower tab associated with each fixing device may provide the protruding surface for forming the retaining gap associated with the fixing device, in co-operation with a section of the upper surface of a lower adjacent cladding board.

In another form of the fixing devices, each fixing device has an engagement member that is in the form of or comprises a bracket-type component having an engagement portion that is shaped and/or configured to engage with the recess of the cladding board. Each engagement portion of the bracket-type component may provide a seat surface upon which a complementary engagement surface within the recess of the cladding board may rest or sit. In one example of this form of fixing device, the bracket-type components extend from the surface of material forming a fixing strip or batten as described above. The bracket-type component may be integrally formed from the material itself, which may for example be metal, steel, aluminium or any other suitable material. The bracket-type component may have a substantially L-shaped cross-sectional profile formed by a base portion that is arranged to extend outwardly relative to the surface of the strip or batten and an engagement portion that extends upwardly from the base portion and which terminates with a hooked-end edge (or seat surface) that bends back toward the strip or batten, the recess of the cladding boards being arranged to receive the engagement portion of the fixing device and having a complementary angled engagement surface for resting or sitting upon the seat surface of the engagement portion in a hook-like engagement or holding relationship to enable the boards to be supported on the fixing devices. In another example of this form of fixing device, the fixing devices are individually mountable to a support structure and are in the form of bracket-type components formed from material such as, but not limited to, metal, steel, aluminium or any other suitable material. The bracket-type components may have a substantially U- or J-shaped cross-sectional profile formed by: a rear portion being arranged for securing directly or indirectly to the support structure; a base portion extending outwardly from the bottom of the rear portion; and a front engagement portion that extends upwardly from the base portion and which terminates with a hooked-end edge (or seat surface) that bends toward the rear portion, the recess of the cladding boards being arranged to receive the engagement portion of the fixing device and having a complementary angled engagement surface for resting or sitting upon the seat surface of the engagement portion in a hook-like engagement or holding relationship to enable the boards to be supported on the fixing devices. Preferably, the portions of each fixing device are integrally formed with each other.

Optionally, each board is provided with grooves along its front and rear surfaces and is arranged to abut another board in a partially overlapping relationship when installed on the support structure such that the grooves of the front and rear surfaces of the overlapping boards co-operate to form a channel.

Preferably, the recess in the rear surface of each cladding board is shaped to engage, abut and/or co-operate with engagement members of the fixing devices to enable the cladding board to be supported in place on the support structure by the fixing devices.

Preferably, the recess comprises an inclined upper engagement surface extending into the board from the rear surface for engaging in a hook-like engagement or holding relationship with the fixing devices. For example, the engagement surface of the recess of the board is arranged to contact and sit or rest upon complementary angled seat surfaces provided by the engagement members of the fixing devices.

Preferably, the recess has a cross-sectional profile comprising: an inclined upper engagement surface extending upwardly into the board from the rear surface of the board, a back surface extending downwardly from the inclined upper surface, and a lower surface extending back to the rear surface of the board from the back surface of the recess.

The fixing system may have any one or more of the features associated with the cladded structure of the first aspect of the invention or the method of the third aspect of the invention.

In a third aspect, the present invention broadly consists in a method of fixing cladding boards onto a support structure in a partially overlapping relationship, each board being defined along its length by front and rear surfaces that extend between upper and lower surfaces, and a recess being provided in and along the rear surface, the method comprising the steps of:

(a) securing rows of spaced-apart fixing devices to the support structure so as to provide retaining gaps between sections of the upper surfaces of each cladding board when installed and protruding surfaces of or associated with the row of fixing devices for supporting the next upper adjacent installed cladding board, each row of fixing devices being arranged to support a board or row of boards and each fixing device having an engagement member that is arranged to engage with a section of the recess of a board to, in co-operation with a number of other fixing devices of that row also engaging with a section of the recess, support the board in place on the support structure;

(b) engaging a first cladding board or first row of cladding boards with the lower-most row of fixing devices such that the engagement members of a number of fixing devices of that row engage into the recess of the rear surface of the first board or first row of boards to support the board in place on the support structure;

(c) inserting one or more resiliently deformable retaining components into at least one of the retaining gaps associated with the or each supported cladding board of the first row such that the retaining components are retained in their respective retaining gaps in a deformed state such that they exert a downward force on the upper surface of their respective cladding board to retain the board in an engaged state with its respective row of fixing devices; and (d) repeating steps (b) and (c) for each next upper adjacent board or row of boards in relation to their respective rows of fixing devices to progressively clad the support structure with boards from the bottom up.

In one form, step (a) comprises providing a number of battens, each batten having a number of fixing devices uniformly spaced apart along its length, and securing the battens in a spaced apart relationship and in a vertical orientation on the support structure such that the fixing devices of the battens are aligned to form the rows of fixing devices.

In another form, step (a) comprises securing individual fixing devices directly to the support structure in a spaced apart arrangement vertically and horizontally with respect to each other to form the rows of fixing devices.

In yet another form, step (a) comprises providing a number of fixing strips, each fixing strip having a number of integral fixing devices spaced apart along its length, and securing the fixing strips in a spaced apart relationship and in a vertical orientation on the support structure such that the fixing devices of the fixing strips are aligned to form the rows of fixing devices.

The installation method of the third aspect of the invention may have any one or more of the features associated with the cladded structure and fixing system of the first and second aspects of the invention respectively.

The phrase "cladded structure" as used in this specification and claims is intended to relate to, unless the context suggests otherwise, either the structure of substantially an entire cladded surface or alternatively the structure of a portion or portions of a cladded surface.

The phrase "resiliently deformable retaining component" as used in this specification and claims, unless the context suggests otherwise, is intended to cover any type of member, body, component, or device that is formed, configured or arranged to be resiliently deformable or compressible in size and/or shape and/or profile with respect to at least one, but possibly multiple dimensions or directions, between a rest state and a deformed state in which the component is compressed in at least one dimension or direction relative to the rest state, whether the resilient deformability is provided by a mechanical configuration or structure of the component (e.g. spring-type arrangements), the resilient properties of the material (e.g. rubber) forming the component, a combination of these or any other suitable means of creating a resiliently deformable component, and where the resilience is sufficient to cause the component to be biased toward reverting to or substantially toward its rest state.

The phrase "cladding board" or term "board" as used in this specification and claims, unless the contexts suggests otherwise, is intended to cover any type, shape, or profile of cladding board, sheathing, or siding for exterior or interior cladding, including, by way of example only, weatherboards, bevel-backed boards and sidings, rusticated or shiplap boards and sidings, fascia and barge boards, or ceilings and soffit lining.

The phrase "support structure" as used in this specification and claims, unless the context suggests otherwise, is intended to cover any surface, structure or framework that is to be clad with boards, including any framing components such as studs or struts, whether timber framing or steel framing, and any type of sheet backing surface, or any other structure such as those formed from concrete panels or concrete blocks, whether in the context of walls, fencing, screens, roofing, ceilings or otherwise.

The phrase "partially overlapping relationship" as used in this specification and claims in the context of partially overlapping adjacent rows of cladding boards is intended to mean any overlapping or interlinking relationship whereby a lower portion of an upper cladding board overlaps or engages with an upper portion of a lower adjacent cladding board, including, but not limited to, configurations where a lower portion of the rear surface or recessed section of the rear surface of the upper cladding board abuts or covers an upper portion of the front surface or recessed section of the front surface of the lower adjacent cladding board.

The term "comprising" as used in this specification and claims means "consisting at least in part of". When interpreting statements in this specification and claims which includes the term "comprising", other features besides the features prefaced by this term in each statement can also be present. Related terms such as "comprise" and "comprised" are to be interpreted in similar manner.

As used herein the term "and/or" means "and" or "or", or both.

As used herein "(s)" following a noun means the plural and/or singular forms of the noun.

The invention consists in the foregoing and also envisages constructions of which the following gives examples only.

BRIEF DESCRIPTION OF THE DRAWINGS

Preferred embodiments of the invention will be described by way of example only and with reference to the drawings, in which:

FIG. 10*a* shows an equivalent view of FIG. 7*a* except for a partially cladded structure in which a first alternative type of cladding boards having flat-backs are secured to the framing with cavity battens carrying modified fixing devices of the first form in accordance with another embodiment of the invention;

FIG. 10*b* shows a close-up view of section F of FIG. 10*a;*

FIG. 10*c* shows a cross-sectional view of the first alternative type of cladding board shown in FIGS. 10*a* and 10*b;*

FIG. 11*a* shows an equivalent view of FIG. 7*a* except for a partially cladded structure in which a second alternative type of cladding boards having flat-backs are secured to the framing with cavity battens carrying modified fixing devices of the first form in accordance with another embodiment of the invention;

FIG. 11*b* shows a close-up view of section G of FIG. 11*a;*

FIG. 11*c* shows a cross-sectional view of the second alternative type of cladding board shown in FIGS. 11*a* and 11*b;*

FIG. 13*a* shows an equivalent view of FIG. 12*c* except for a partially cladded structure in which a first alternative type of cladding boards having flat-backs are secured to the framing with cavity battens carrying modified fixing devices of the second form in accordance with another embodiment of the invention;

FIG. 13*b* shows a close-up view of section J of FIG. 13*a;*

FIG. 14*a* shows an equivalent view of FIG. 12*c* except for a partially cladded structure in which a second alternative type of cladding boards having flat-backs are secured to the framing with cavity battens carrying modified fixing devices of the second form in accordance with another embodiment of the invention;

FIG. 14*b* shows a close-up view of section K of FIG. 14*a;*

DETAILED DESCRIPTION OF PREFERRED EMBODIMENTS

General Overview

In general, the invention relates to a substantially concealed fixing system for securing or mounting cladding boards to a support structure to be clad, such as, but not limited to, the framing or walls of a building. The fixing system comprises rows of spaced-apart fixing devices, supported directly or indirectly by the support structure. Each fixing device comprises an engagement member that is shaped and/or configured to engage with a section of a complementary recess provided in and along the rear surface of the cladding board to hold or fix it in place upon the device. Each row of fixing devices is arranged to support a board or row of boards via engagement of a number of fixing devices into a complimentary recess provided in the rear surface of each board. To further secure the cladding board to the respective row of fixing devices, a plurality of resiliently deformable retaining components are inserted or located in a deformed state within retaining gaps provided between sections of the upper surface of each of the boards or rows of boards and protruding surfaces of or associated with the row of fixing devices that supports the next upper adjacent board or row of boards. The resiliently deformable retaining components operate to exert a downward force on the upper surface of the cladding boards so as to hold or lock them in an engaged state with their respective row of fixing devices. The rows of cladding boards are secured in a partially overlapping relationship such that a lower portion of the rear surface or a recessed section of the rear surface of an upper adjacent cladding board covers or abuts an upper portion of the front surface or a recessed section of the front surface of a lower adjacent cladding board.

By way of example, various embodiments of the fixing system and cladded structure will now be described in further detail with respect to a range of different forms of fixing devices and types of cladding-board profiles.

Embodiments Using First Form of the Fixing Devices—Engagement Formations

Embodiments of the cladded structure using a first form of the fixing devices having engagement members in the form of engagement formations will now be described.

Bevel-Backed Weatherboards

Referring to FIGS. 5-9*c*, an embodiment of the fixing system and cladded structure 20 will be described by way of example for bevel-backed weatherboards.

Figure 5:
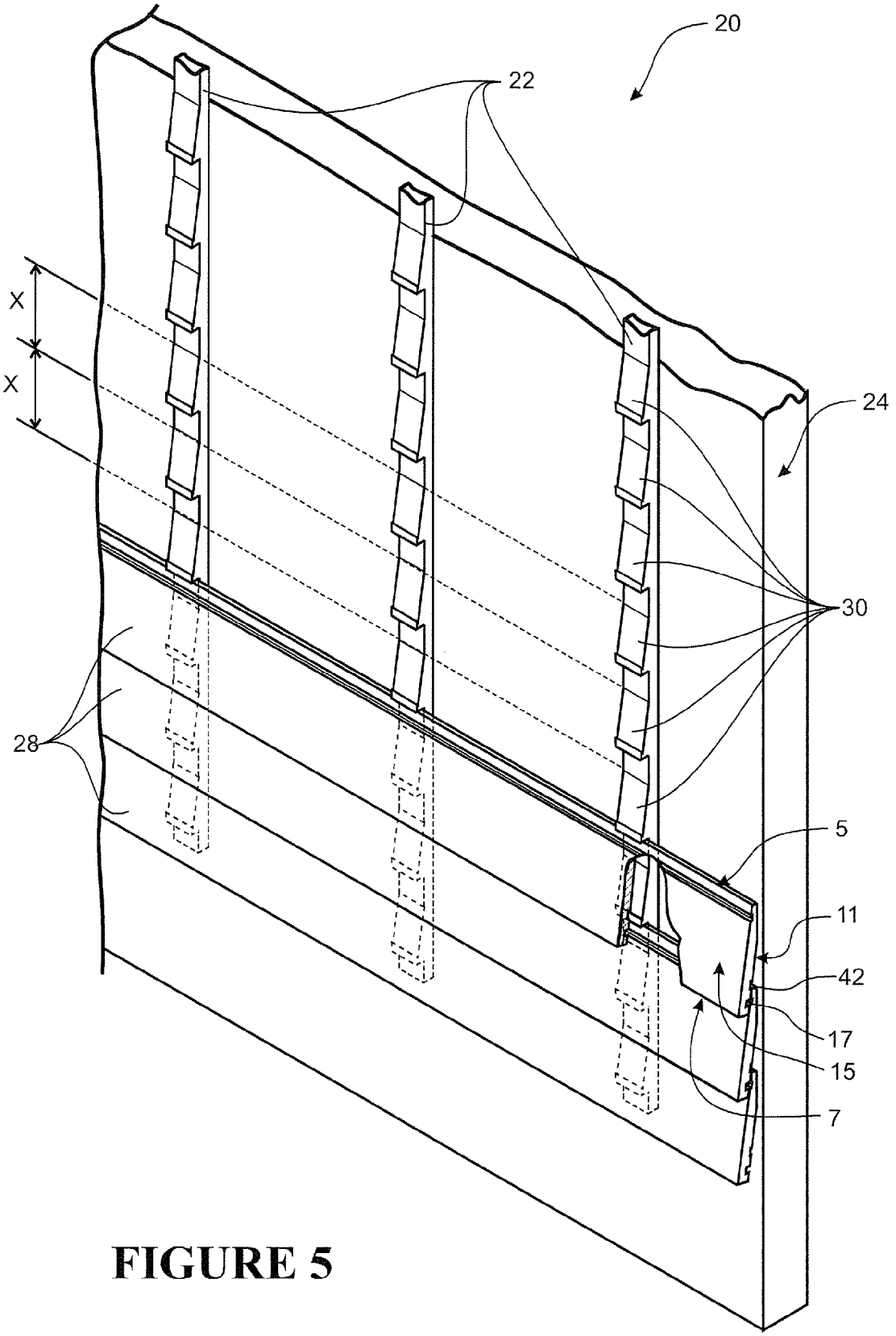
FIG. 5 shows a perspective view of a partially cladded structure in which bevel-backed weatherboards are secured to a wall with cavity battens carrying a first form of the fixing devices having engagement formations in accordance with an embodiment of the cladded structure.
Figure 6:
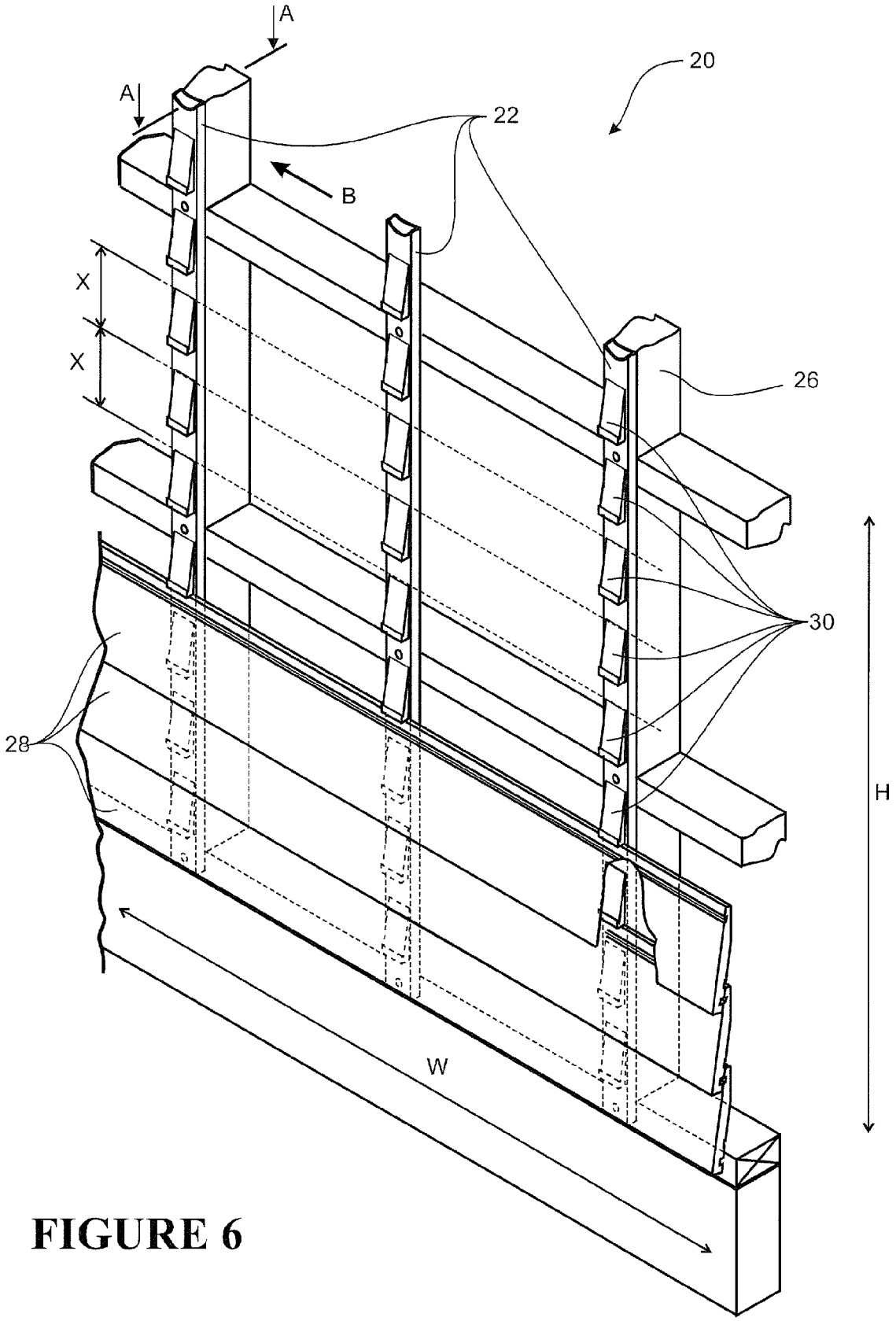
FIG. 6 shows another partially cladded structure similar to that of FIG. 5 except where the weatherboards are secured to framing with cavity battens.

Referring to FIGS. 5 and 6, the cladded structure 20 comprises a number of elongate cavity battens 22 that are attached or secured to a support structure, such as the exterior surface of a wall 24 (FIG. 5) or framing 26 (FIG. 6). The cavity battens 22 may be attached or secured to the wall 24 or framing 26 via fixing components such as nails or screws, or adhesive, or any other fixing means. The battens 22 are preferably installed in a vertical orientation and are spaced apart along the wall 24 or framing 26. They are also preferably aligned to form rows of fixing devices 30. The rows of fixing devices are configured to support rows of partially overlapping cladding boards 28 as shown.

Figure 1:
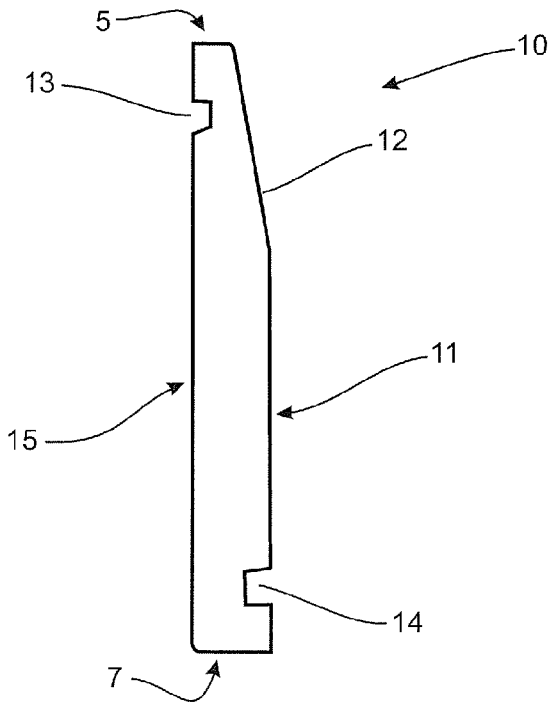
FIGURE 1 (Prior Art)
FIG. 1 shows a cross-sectional view of a prior art weatherboard design.
Figure 2:
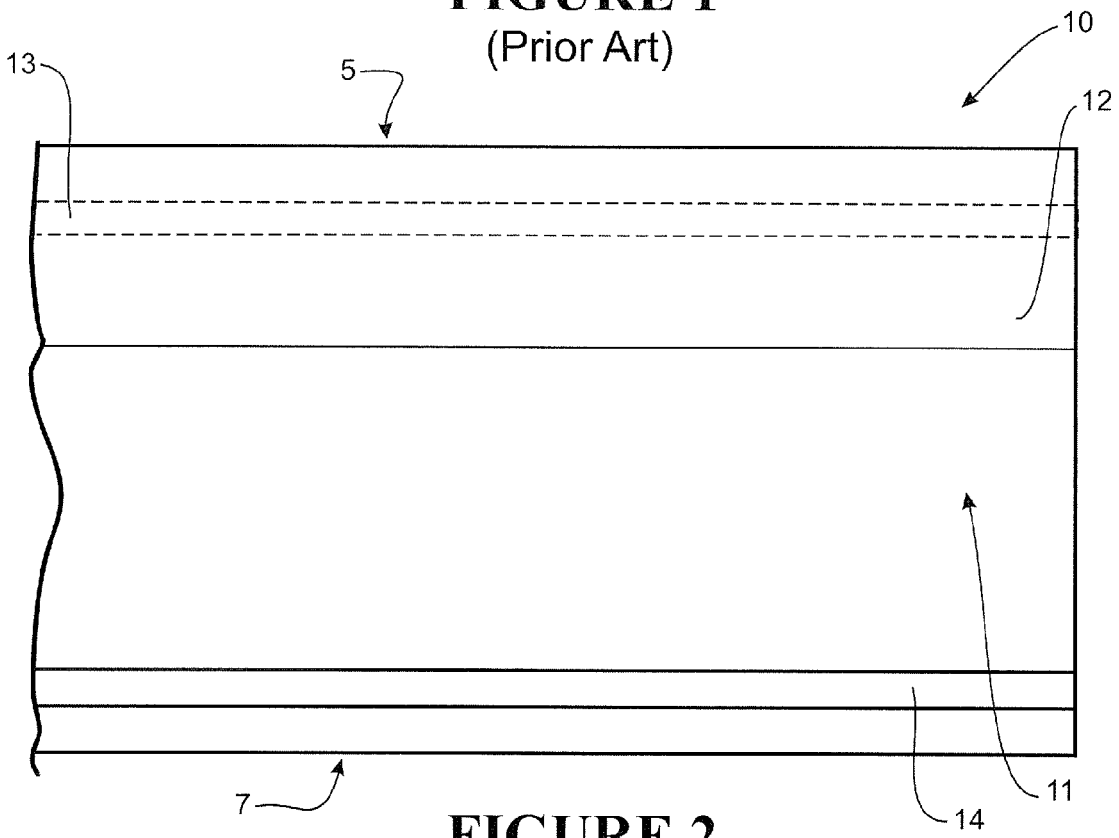
FIGURE 2 (Prior Art)
FIG. 2 shows a front view of the prior art weatherboard design of FIG. 1.
Figure 3:
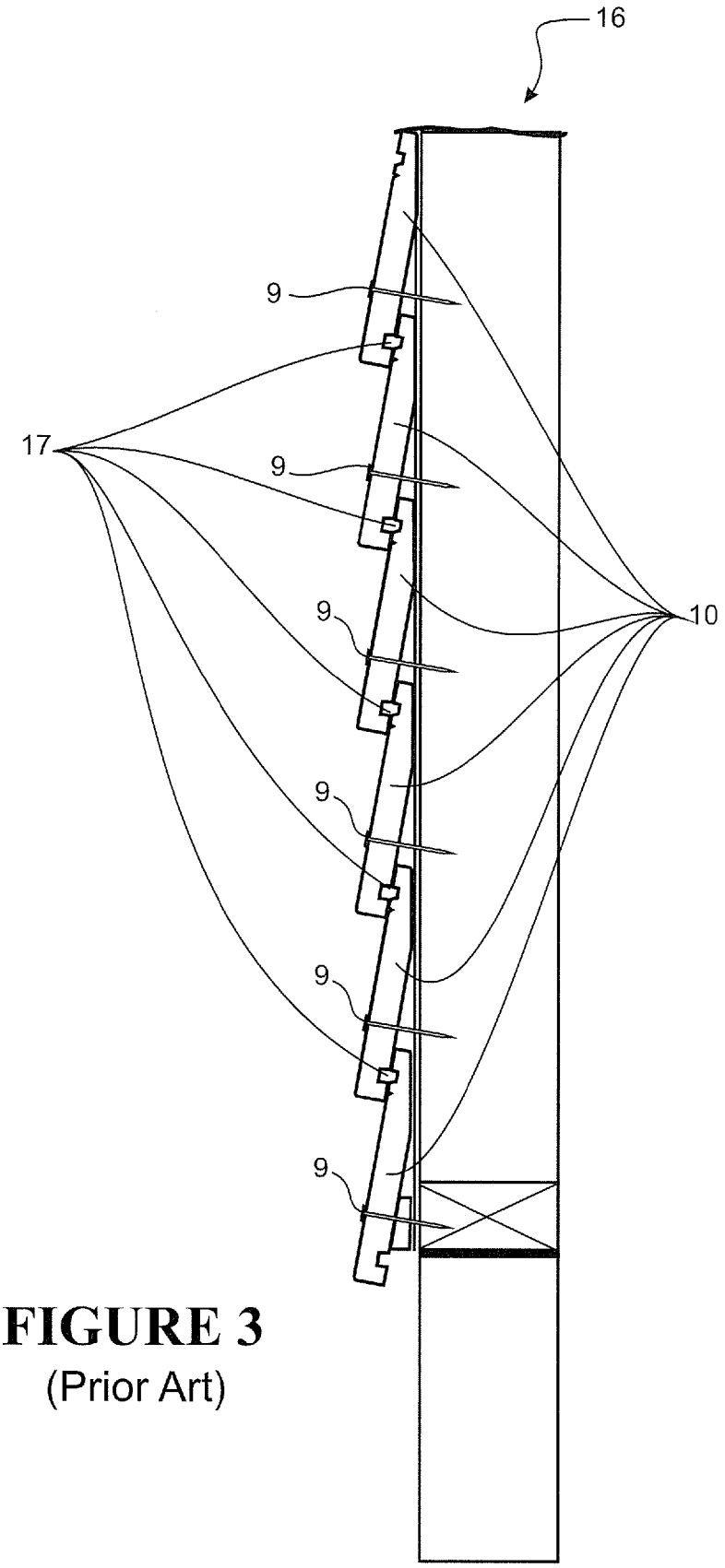
FIGURE 3 (Prior Art)
FIG. 3 shows a cross-sectional view of a series of the prior art weatherboards of FIGS. 1 and 2 installed on the framing of a building with nails.
Figure 4:
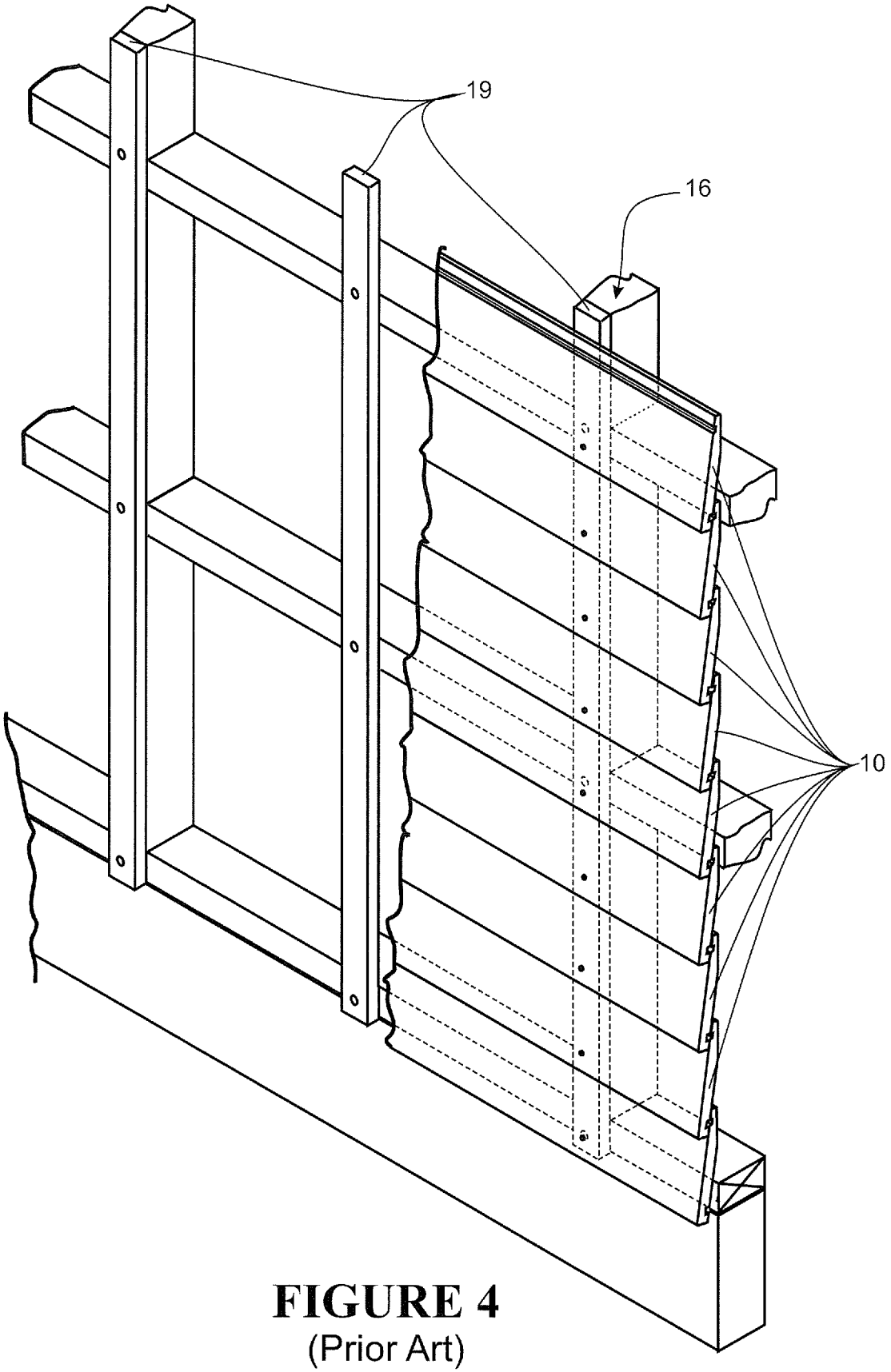
FIGURE 4 (Prior Art)
FIG. 4 shows a perspective view of a prior art weatherboard cladding system that utilises cavity battens in between the framing and weatherboards.

In this embodiment, the cladding boards are in the form of a bevel-backed weatherboard having a profile similar to that described with reference FIG. 1. For example, each elongate board is defined along its length by front 15 and rear 11 surfaces that extend between upper 5 and lower 7 surfaces. Additionally, a recess 42 is provided in and along the rear surface 11 of the board into which the engagement members of the fixing devices may engage to support the board on the support structure. Optionally, anti-capillary grooves 13,14 may be provided on the front 15 and rear 11 surfaces respectively for forming anti-capillary channels 17 as previously explained. It will be appreciated that the cladding board profiles do not need to provide anti-capillary channels or grooves and that any other cladding board cross-sectional profile may alternatively be used with the fixing system, and that many different weatherboard or cladding board designs and profiles could provide an equivalent or similar overlapping relationship between the boards.

Each cavity batten 22 is provided with a number of fixing devices 30 spaced apart along its length by a predetermined spacing distance X. The fixing devices 30 include an engagement member or portion that is shaped to engage with or into a section of the complementary recess 42 provided in and along the rear surface 11 of a board. The cavity battens 22 are arranged such that, when installed, the fixing devices 30 form rows, each row of fixing devices 30 being arranged to engage into a board or row of boards to hold the board or boards in place against the battens and/or support structure underneath. In particular, a number of fixing devices 30 of a row are arranged to co-operate together to engage in sections of the complementary recess of a board to hold the board in place against the wall 24 or framing 26.

The configuration of the engagement member of the fixing device and the complimentary recess in the rear surface of the cladding board may vary depending on requirements. In this embodiment, the fixing device has an engagement member in the form of an engagement formation 40 (as will be explained and shown in further detail with reference to FIGS. 7*a*-7*c*) that is shaped and/or configured to operate like a hook for engaging into the recess such that the cladding board 28 hangs from the fixing device. For example, in this embodiment the engagement formation provides a seat surface upon which a section of a complementary engagement surface within the recess of the cladding board may rest or sit to hold it in place on the support structure. However, in alternative embodiments it will be appreciated that the engagement member and complimentary recess may be configured for a friction-fit or any other hook-like, locking or holding configuration or relationship. In this embodiment, the recess is provided in the lower half of the rear surface 11 of the cladding board toward the lower surface 7 of the cladding board near the overlapping region of adjacent cladding boards.

As described above, the rows of fixing devices are spaced-apart by a predetermined spacing distance X that is preferably calculated based on the dimensions of the cladding board profile and desired overlap so as to provide retaining gaps (not visible in FIGS. 5 and 6) between sections of the upper surface 5 of each cladding board and the lower portions of or associated with the fixing devices associated with supporting the next upper adjacent cladding board on the support structure. As mentioned above and which will be explained in further detail later, the retaining gaps are arranged to receive and retain resiliently deformable retaining components that may be inserted into the gap during installation of the cladding board to thereby assist in holding or locking the cladding boards onto their respective row of fixing devices.

Figure 7A:
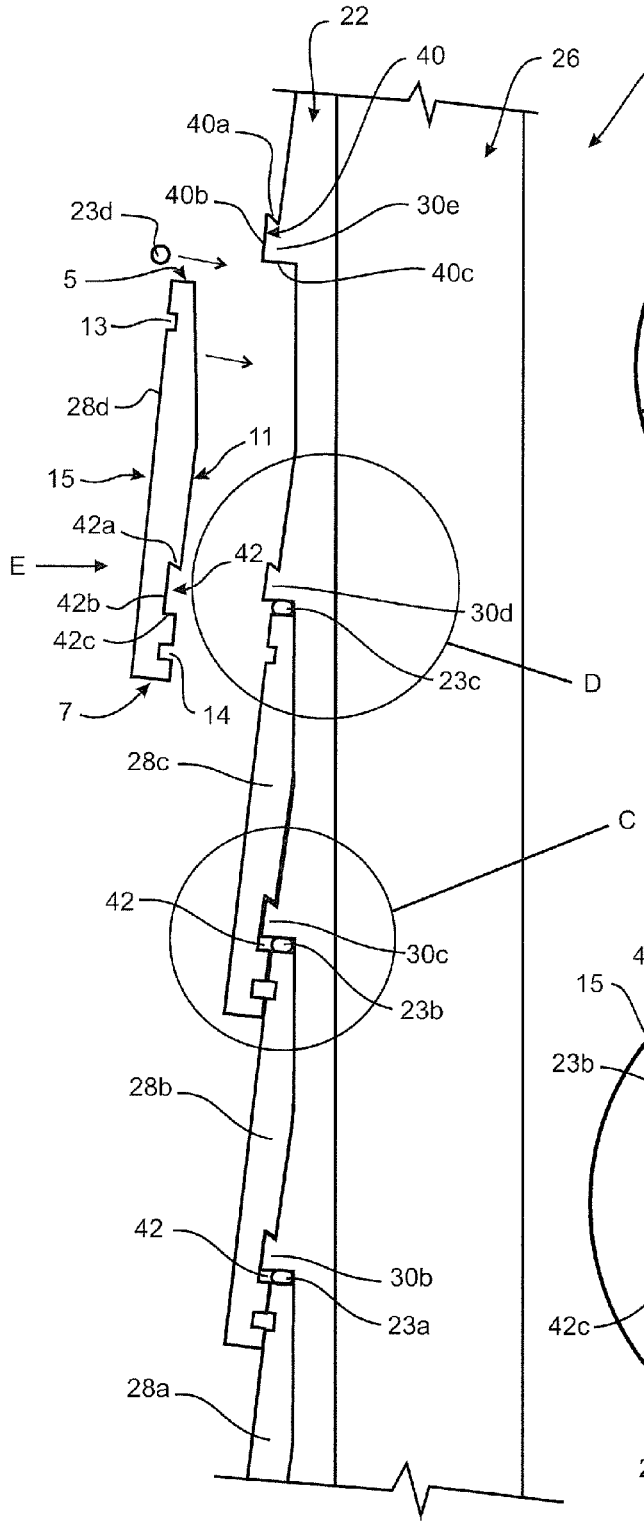
FIG. 7*a* is a cross-sectional view through line AA viewed in direction B in FIG. 6 and showing the next weatherboard to be installed.
Figure 7C:
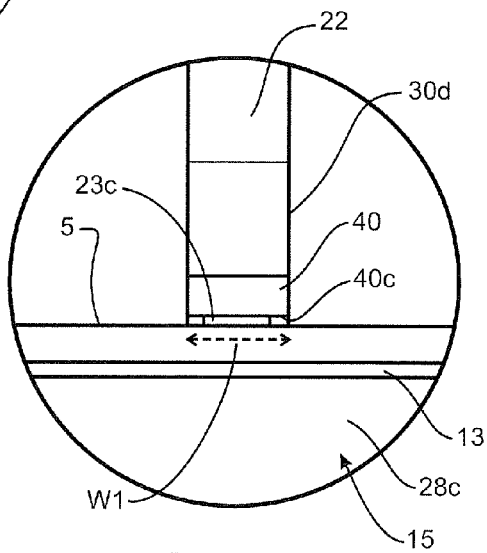
FIG. 7*c* shows a close-up front view of section D of FIG. 7*a* viewed in direction E.
Figure 7B:
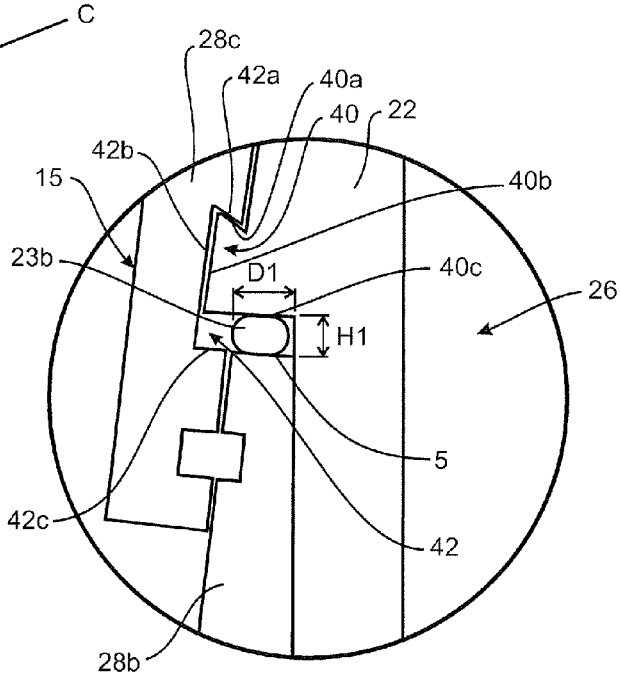
FIG. 7*b* shows a close-up view of section C of FIG. 7*a;*

Referring to FIGS. 7*a*-7*c*, the mounting of the cladding boards to the support structure 26 via the fixing devices 30 and retaining components 23 will be explained in further detail. FIG. 7*a* shows a partially cladded structure with three rows of cladding boards 28*a*-28*c* mounted to the support structure, which in this case is framing 26. As shown, each of the installed cladding boards 28*a*-28*c* are supported by a respective row of fixing devices 30*a*-30*c* that each have an engagement formation 40 that engages into a complimentary recess 42 provided in and along the rear surface of each cladding board. In this embodiment, each row of cladding boards effectively hangs on a corresponding row of fixing devices (as more clearly shown in FIGS. 5 and 6). Additionally, resiliently deformable retaining components 23 are located in complimentary retaining gaps provided between sections of the upper surface 5 of each cladding board and corresponding lower surfaces or portions of or associated with each of the fixing devices associated with the next upper adjacent row of cladding boards. FIG. 7*a* shows the retaining components 23*a*-23*c* associated with the retaining gaps formed by fixing devices 30*a*-30*c*, but it will be appreciated that each row of cladding boards comprises multiple spaced-apart retaining gaps and retaining components associated with the multiple fixing devices of each row. When installed in a retaining gap, each retaining component 23 is compressed or stretched from its rest state into a deformed state such that, when released, its resilient nature acts to expand to apply downward force on the upper surface 5 of the cladding board to hold or retain it in place upon its respective row of fixing devices to prevent the board from moving upwards sufficiently to be dislodged from its row of fixing devices.

FIG. 7*a* also shows the next cladding board or row of cladding boards 28*d* ready to be installed on its respective row of fixing devices 30*d*. During installation, the cladding board 28*d* will be mounted onto its row of fixing devices 30*d* such that the engagement formation 40 of fixing device 30*d* (and any other associated fixing devices of the row) engages with the recess 42 to hold the board in place on the framing 26. Once the cladding board is mounted, the retaining component 23*d* (shown in an un-deformed or rest state) is inserted or wedged into the retaining gap provided between the upper surface 5 of the cladding board 28*d* and a lower portion or surface 40*c* of the engagement formation 40 of the fixing device 30*e* associated with the next adjacent upper row of cladding boards (not shown) to thereby lock or retain the board 28*d* in place. In this embodiment, each cladding board is supported along its length by two or more fixing devices of a row, and each fixing device engages in a respective section of the recess 42 of the board at spaced-apart intervals along its length. In this embodiment, retaining gaps are formed between sections of the upper surface of each cladding board and the associated fixing devices for the next upper adjacent row of boards and preferably one or multiple retaining components are inserted in each retaining gap associated with the cladding boards such that all retaining gaps are filled for maximum securement of the boards. However, it will be appreciated that not all retaining gaps need to be utilised and in other embodiments a retaining component 23 may be located in at least one retaining gap associated with each cladding board for sufficient securement of the boards.

Figure 9A:
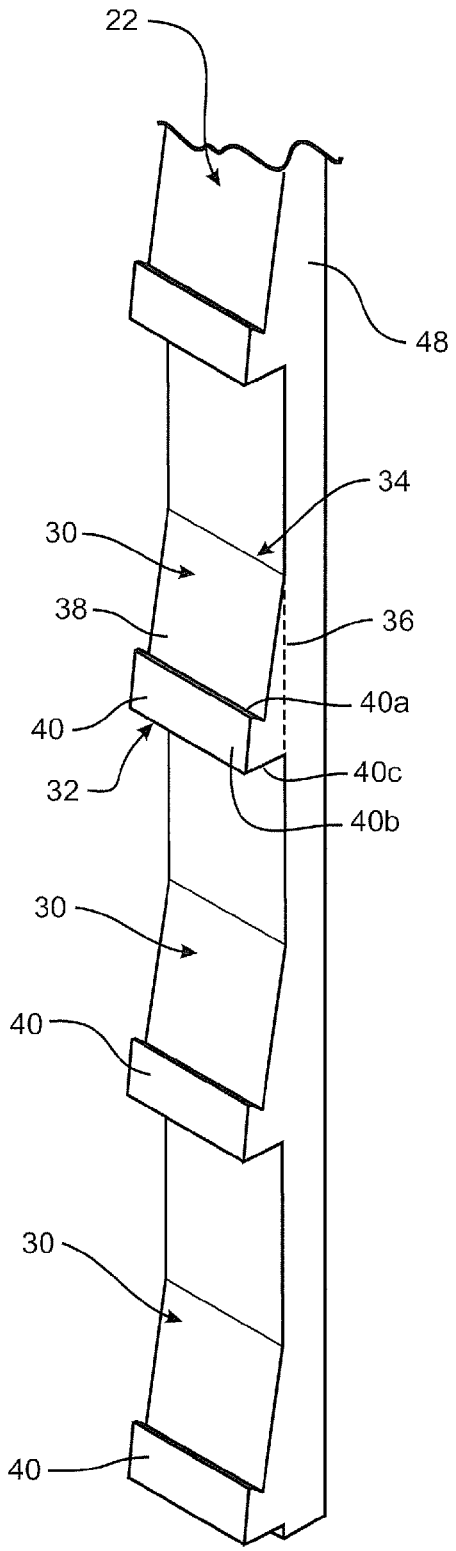
FIG. 9*a* shows a perspective view of a cavity batten comprising the first form of the fixing devices.

Referring to FIGS. 7*b* and 9*a*, the mounting of adjacent cladding boards 28*b* and 28*c* will be described by way of example, and the same configuration and arrangement applies to the remaining rows of boards in the cladded structure. The fixing devices 30 in this embodiment have a substantially wedge-shaped cross-sectional profile and comprise engagement members in the form of engagement formations provided at or toward the base of the wedge profile or body. As shown in FIG. 9*a*, the wedge-shaped cross-sectional profile comprises a base end 32 that tapers into a pointed top-end 34. In this embodiment, the retaining gap for retaining component 23*b* associated with the lower cladding board 28*b* is provided between a section of the upper surface 5 of lower cladding board 28*b* and a lower protruding surface or portion 40*c* (in this case at the base end 32) of the fixing device 30*c* associated with the upper adjacent cladding board 28*c*. In this embodiment, the cross-sectional profile of the fixing devices 30 is defined by a flat rear face 36 and an inclined front face 38 which meet at the pointed top-end or edge 34. As shown in FIG. 7*a*, in this embodiment the front face 38 of the fixing device 30*c* is arranged to abut the rear surface of board 28*c*. Protruding from the front face 38, at or toward the base end 32, is an engaging or engagement formation 40 that is shaped to securely engage or co-operate with the complementary recess 42 provided in and along the rear face of board 28*c*. In particular, the engagement portion 40 may be shaped and/or configured such that it hooks into the recess 42 of the board to thereby support the weight of the board and hold it in place against the cavity battens 22 and framing 26. As shown in FIG. 7*b*, in this embodiment the engagement formation 40 is defined at least partially by a cross-sectional profile comprising an upper inclined seat surface 40*a* and a lower opposite horizontal surface 40*c* that extend outwardly from the underlying wedge-shaped component and are joined by a front vertical surface 40*b*.

In this embodiment, the complementary recesses 42 of the boards 28 are preferably provided with a complementary angled engagement surface 42*a* that is configured to abut and/or engage with the seat surface 40*a* of the engagement formation 40 such that the cladding boards may sit or rest on their respective row of engaged fixing devices securely in a hook-like engagement or holding relationship. With reference to FIG. 7*a* and board 28*d*, the recess 42 of the board 28*d* may, for example, have a cross-sectional profile that comprises the upper angled engagement surface 42*a* and an opposing lower surface 42*c* that extends into the board from the rear surface 11 and which are joined by a substantially perpendicularly extending back surface 42*b*.

Referring to FIG. 7*c*, a front view of installed cladding board 28*c* and a fixing device 30*d* of the row of fixing devices associated with the next upper adjacent row of cladding boards 28*d* is shown. In this view, an upper portion of cladding board 28*c* is shown, including a portion of its front surface 15 and anti-capillary groove 13. The retaining component 23*c* can be seen located in the retaining gap provided by the space between the upper surface 5 of the cladding board 28*c* and the lower portion 32 of fixing device 30*d*. As previously explained, the rows of fixing devices are spaced-apart from each other by a predetermined spacing distance X based on the dimensions of the cladding boards and desired overlap between adjacent rows of boards such as to provide sufficiently sized retaining gaps for receiving the complimentary retaining component.

Retaining Components

In this embodiment of the cladded structure 20 shown in FIGS. 7*a*-7*c*, the retaining components 23 are material-type retaining components that are members or bodies formed from a resiliently deformable material, such as rubber or any other substantially hard but resilient material, including but not limited to silicone and plastic polymers. The retaining components are preferably oversized in cross-section relative to the cross-sectional size of the retaining gap as viewed in FIG. 7*b* such that they are retained in a deformed state when installed in their respective retaining gaps. As shown in FIG. 7*c*, the retaining components may be elongate components that extend substantially the width W1 of the retaining gap (effectively defined by the width of the lower surface 40*c* of the fixing device in this embodiment), although the length may be greater than W1 in other embodiments. In this form, the width W1 of the retaining gap is defined in the longitudinal direction of the cladding boards. In other alternative embodiments, the retaining components may be short or non-elongate components that are retained in only a small portion of the overall width of the retaining gap as viewed from FIG. 7*c*. As shown, the retaining gap comprises a single retaining component, but in alternative embodiments the retaining gap may receive one or more retaining components if desired. In one preferred embodiment, the retaining components have a thickness/width or cross-sectional size when in a deformed state in situ looking in the direction of FIG. 7*b* (e.g. the transverse thickness or cross-sectional size relative to the longitudinal axis of the retaining components if elongate) that substantially corresponds or is substantially equal to the depth D1 of the retaining gap. In this form, the depth D1 of the retaining gap is defined in a direction that corresponds to the thickness of the cladding boards, i.e. in a direction extending between the front and rear surfaces of the cladding boards. When in a rest state, the retaining components have a height that is greater than the height H1 of the retaining gap as shown in FIG. 7*b* such that the retaining component is deformed into or held in a compressed state when installed in the retaining gap. In this form, the height H1 of the retaining gap is defined in a direction corresponding to the width of the cladding boards, i.e. in a direction extending between the upper and lower surfaces of the cladding boards.

Referring to FIGS. 8*a*-8*d*, the material-type retaining components may have various cross-sectional shapes, including circular, square, rectangular, hexagonal, trapezoidal or any other suitable cross-sectional shape. The cross-sectional shape may be uniform as shown or alternatively non-uniform along their length. The cross-sectional shape of the retaining components may be configured to compliment the cross-sectional shape of the retaining gap as viewed from FIG. 7*b*, but also being oversized to create some compression or deformation of the retaining components when installed in the retaining gaps.

Figure 8A:
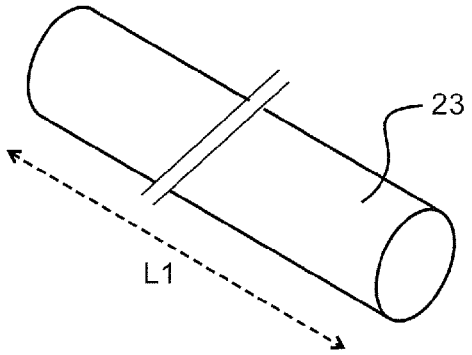
FIGS. 8*a*-8*e* show perspective views of examples of material-type retaining components formed from a resiliently deformable material.
Figure 8B:
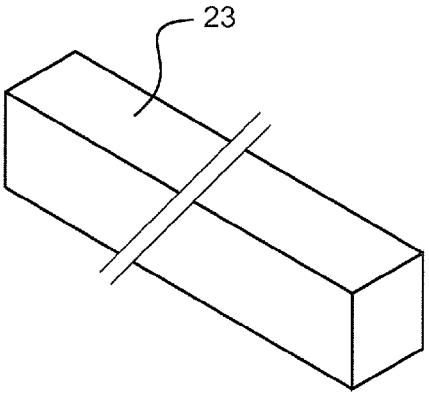
Figure 8C:
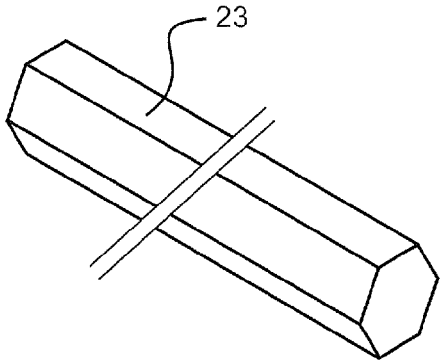
Figure 8D:
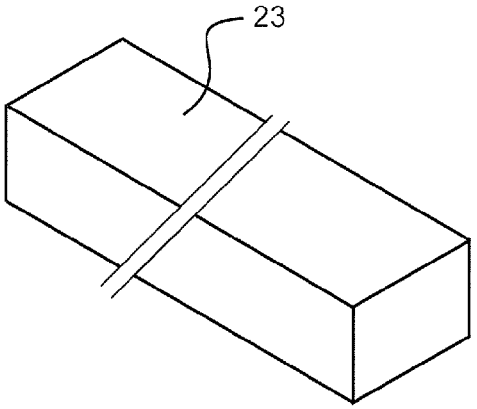
Figure 8E:
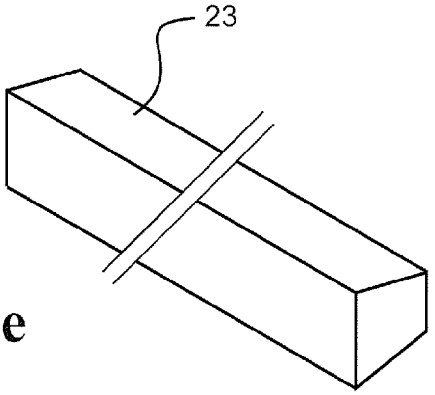

By way of example with reference to FIG. 8*a*, the material-type retaining components are elongate and formed from material that is resiliently extendible in length L1 relative to the longitudinal axis of the member such that the average cross-sectional area of the member transverse to the longitudinal axis reduces in size when the member is stretched or extended in length, and which substantially reverts to or toward its original size or rest state when at rest with no extension force or pressure applied.

In other embodiments, the cladded structure may be provided with mechanical-type retaining components in which the mechanical structure of the component is configured or arranged to provide resilient deformability so as to serve the same function as the material-type retaining components described above when installed in the retaining gaps. For example, the components may have a spring type structure or arrangement. FIGS. 8*f*-8*j* shows various examples of possible mechanical-type retaining components 24 that may be employed, although it will be appreciated that any other suitable configurations or arrangements forming springy components may be used if desired.

Figure 8F:
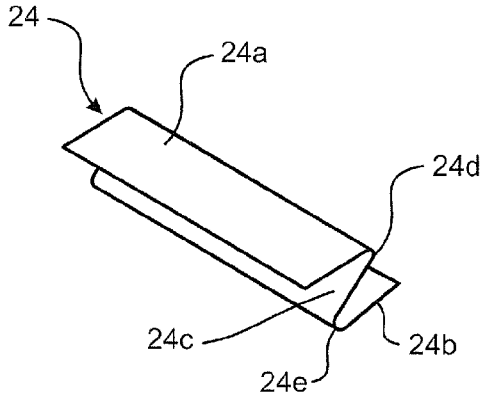
FIGS. 8*f*-8*h* show perspective views of examples of mechanical-type retaining components having a springy configuration provided by a bent or shaped metal plate, the components being shown in a deformed state.
Figure 8G:
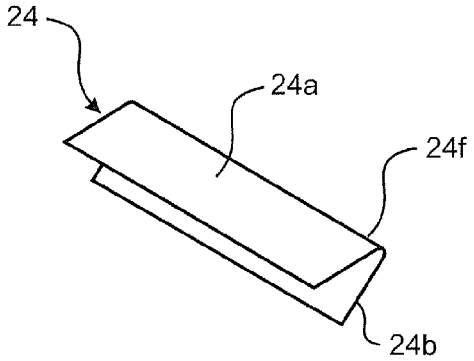
Figure 8H:
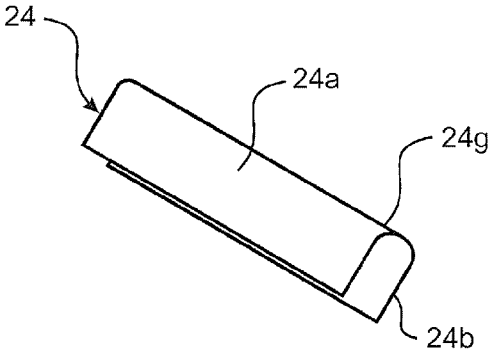

The three examples shown in FIGS. 8*f*-8*h* are mechanical-type retaining components that are formed from a shaped or bent plate or piece of material, such as metal, to form a resiliently springing component. It will be appreciated that other suitable materials could also be used. The first example in FIG. 8*f* shows a resiliently springy component that is formed from a plate of metal that is bent or shaped into an elongate springy component having a substantially Z-shaped cross-sectional profile along its length. More particularly, the cross-sectional profile is defined by an upper flat surface 24*a* and an opposing lower flat surface 24*b* that are joined at two respective bending regions 24*d*,24*e* by a diagonally extending intermediate surface 24*c*. The Z-shaped retaining component is springy in that it may be compressed from a rest state in which the opposing upper 24*a* and lower 24*b* surfaces are displaced from each other to a deformed state (shown) in which the surfaces 24*a*,24*b* are closer together relative to the rest state by virtue of an external force or pressure such as that applied when the components are within their retaining gaps. In this first example, the surfaces 24*a*,24*b* are substantially parallel when in the deformed state. The arrangement and material of the retaining component is resilient such that it is biased toward uncompressing or reverting to or substantially toward its rest state from its deformed state. The second example in FIG. 8*g* (shown in a deformed state) is a similar elongate springy component in that it comprises upper 24*a* and lower 24*b* surfaces that may be compressed toward each other relative to a rest state, but which is biased toward reverting to the rest state, to form a resilient springy component, but where the surfaces 24*a*,24*b* are joined by a narrow single bending region 24*f* such that the component has a substantially V-shaped cross-sectional profile along its length. The surfaces 24*a*,24*b* are not parallel in their deformed state in this second example. The third example in FIG. 8*h* (shown in a deformed state) is another similar elongate springy component in that it comprises upper 24*a* and lower 24*b* surfaces that may be compressed toward each other, but biased toward the rest state, to form a resilient springy component, but where the surfaces 24*a*,24*b* are joined by a wider bending region 24*g* such that the component has a substantially U-shaped cross-sectional profile along its length. The surfaces 24*a*,24*b* are substantially parallel when in the deformed state in this third example.

Figure 8I:
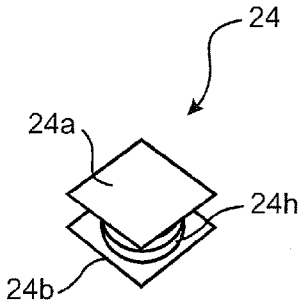
FIGS. 8*i* and 8*j* show perspective and side elevation views respectively of an example of a mechanical-type retaining component having a springy configuration provided by a coiled spring, and being shown in a deformed state.
Figure 8J:
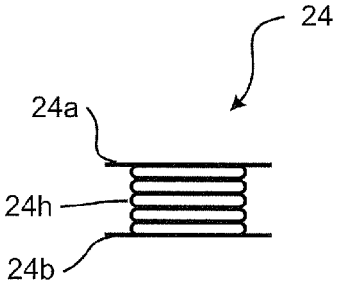

The example shown in FIGS. 8*i* and 8*j* is a mechanical-type retaining component that is formed from upper 24*a* and lower 24*b* plates that are joined together by a spring member 24*h*, such as but not limited to a coiled spring. The spring member 24*h* allows the upper and lower surfaces 24*a*,24*b* to be compressed toward each other from a rest state, but biases the surfaces to revert back to or substantially toward the rest state like in the configurations in the examples of FIGS. 8*f*-8*h* above. FIGS. 8*i* and 8*j* show the retaining component in a deformed state with the coiled spring 24*h* compressed and the surfaces or plates 24*a*,24*b* being substantially parallel to each other and closer to each other relative to the rest state.

It will be appreciated that the entire or at least a portion of the upper and lower surfaces 24*a*,24*b* of the mechanical-type retaining components in the above examples of FIGS. 8*f*-8*i* are provided as contact surfaces for engaging with upper and lower surfaces of the retaining gaps of the cladded structure when in use and retained in the retaining gaps in a compressed state. In particular, upper surface 24*a* of the retaining component is arranged to contact or abut against the protruding surface associated with the fixing device that forms the upper surface of the retaining gap and the lower surface 24*b* is arranged to contact or abut against a section of the upper surface of the cladding board that forms the lower surface of the retaining gap. In some examples of the mechanical-type retaining components, such as those shown in FIGS. 8*f*, 8*h*, 8*i*, and 8*j*, substantially the entire upper and lower surfaces 24*a*, 24*b* are configured to contact their respective surfaces of the retaining gaps, but in other examples, one such being shown in FIG. 8*g*, only a portion or edge of the surfaces 24*a*,24*b* engage with the corresponding surfaces of the retaining gap. As shown, the upper and lower surfaces 24*a*,24*b* are typically substantially flat in profile, although this is not essential. As with the material-type retaining components, it will be appreciated that the length of the retaining components may be longer, substantially the same, or shorter than the width of the retaining gaps. Likewise, the thickness (in the horizontal direction when looking at the cross-section relative to the longitudinal axis) of the retaining component when in a deformed state may be greater, substantially the same, or smaller than the depth of the retaining gap. The height (in the vertical direction when looking at the cross-section relative to the longitudinal axis) of the retaining component between the upper and lower contact surfaces 24*a*,24*b* is greater than the corresponding height of the retaining gap to create the compression when the retaining components are installed in their retaining gaps.

In regard to both the material-type retaining components and mechanical-type components, or any other such resiliently deformable retaining component, it will be appreciated that one or more applicable properties of the retaining components, for example size, dimensions including length, width and/or height, shape, mechanical configuration, material and/or resilience, and the size and/or shape of the complementary retaining gaps may be selected to ensure that the retaining components when inserted or installed within their respective retaining gaps provide continuing downward pressure on their associated cladding boards when installed, including taking into account possible expansion or contraction of the boards and any widening or shrinking of the receiving gaps that may occur over time, for example, as a result of variation in the moisture content of the boards or fixing devices.

Figure 9B:
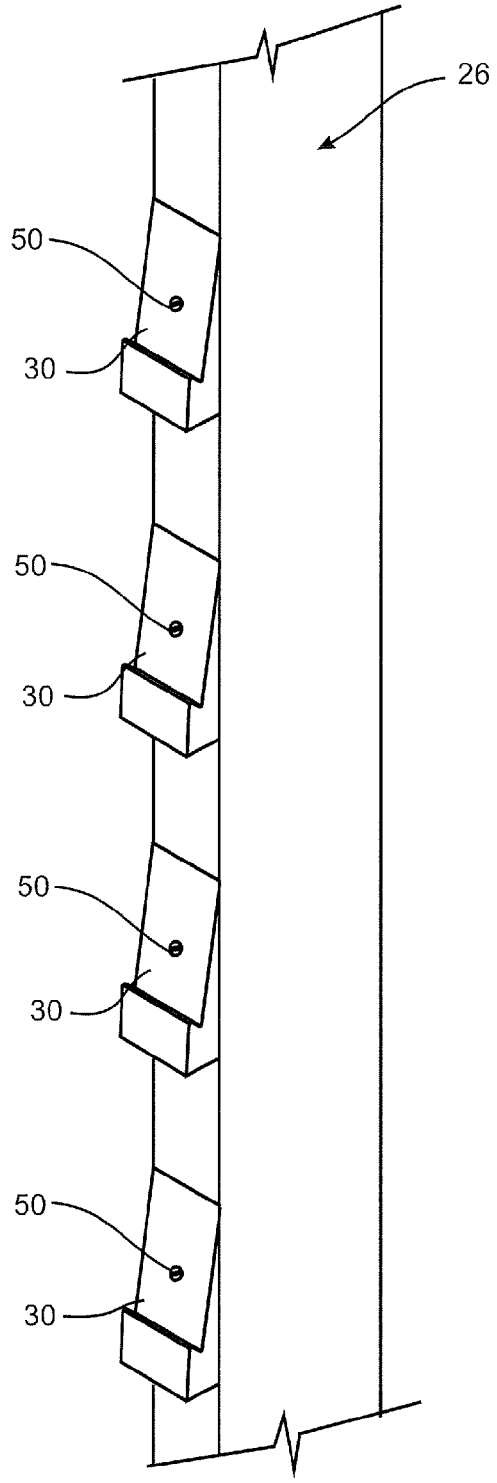
FIG. 9*b* shows a perspective view of the first form of the fixing devices where they are individually formed and secured to a support structure to be clad.
Figure 9C:
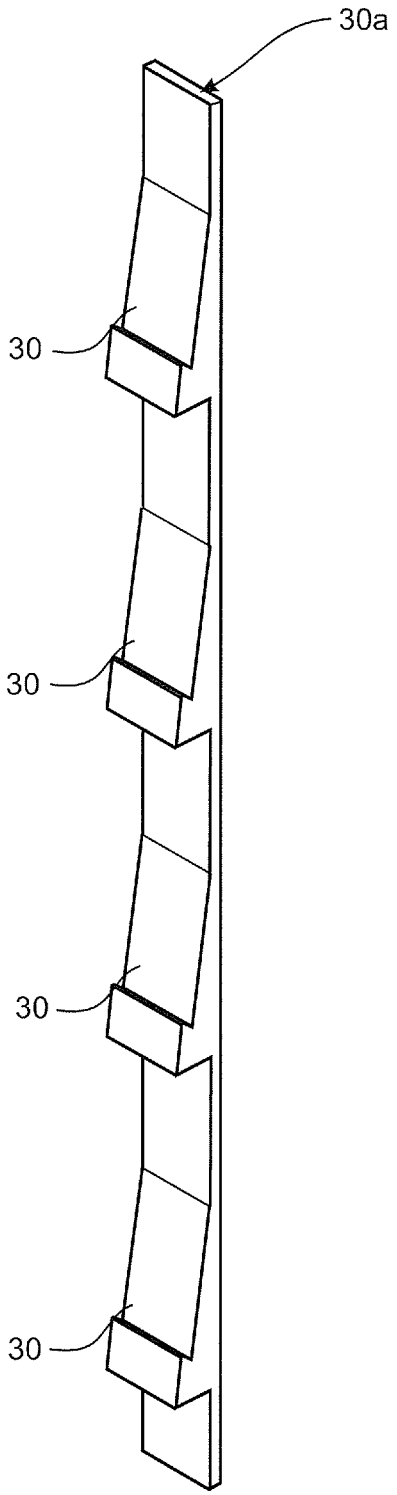
FIG. 9*c* shows a perspective view of a fixing strip comprising the first form of the fixing devices.

The rows of fixing devices 30 may be provided in various forms on the support structure in a spaced-apart relationship vertically up the height (in the direction shown by arrow H in FIG. 6) and aligned across the width (in the direction shown by arrow W in FIG. 6) of the cladded structure to form the required rows of fixing devices. Reference to the height and width of a substantially vertically extending support structure is used by way of example only, and it will be appreciated that the support structure to be clad may have any orientation. FIGS. 9*a*-9*c* show embodiments of the fixing devices provided on cavity battens, in individually mountable form, and in fixing strips respectively, and each will be explained in more detail in the following paragraphs. Any of these embodiments of the fixing devices may be employed in the cladded structure depending on requirements.

Referring to FIG. 9*a*, a cavity batten 22 is shown in isolation. Each cavity batten 22 comprises an elongate base member 48 having a number of fixing devices 30 spaced apart along its length. The fixing devices 30 are identical in profile and are spaced apart on the batten 22 by a uniform predetermined distance calculated based on the dimension of the boards being installed, the desired overlap required for the boards, and the dimension of the retaining gaps required. It will be appreciated that the fixing devices may be integrally formed with the elongate base member 48. For example, the cavity batten may be formed from wood or any other suitable material and may be profiled or cut to provide a plurality of fixing devices 30 on its front face. Alternatively, it will be appreciated that the fixing devices 30 may be individually formed and cut and attached individually to the base member 48 of the cavity batten 22 via adhesives, nails, screws, or other fixing means. It will be appreciated that the cavity batten may be formed as one uniform integral component or by an interconnection of the base member 48 and a number of fixing devices 30. The battens may be formed from any suitable type of material, such as wood, plastic, metal, steel or any combination thereof. The battens may be any desired length as required.

As mentioned, it is desirable to utilise cavity battens to provide cavities in between the cladding boards and support structure, such as framing, for drainage purposes, especially when the cladding boards are likely to be exposed to particularly harsh weather conditions. However, it will be appreciated that alternative embodiments of the cladded structure need not utilise cavity battens. In particular, the fixing devices 30 may be manufactured individually and directly attached to the framing 26 of the building such that they are spaced apart vertically and horizontally on the face of framing to form rows, each row being arranged to receive and retain an individual cladding board or row of boards.

Referring to FIG. 9*b*, individually mountable fixing devices 30 are shown directly coupled or connected to the framing 26 with fixing components 50, such as screws, nails or the like.

Referring to FIG. 9*c*, the fixing devices 30 may be formed in integral plates or fixing strips 30*a* of any desired length and from metal, steel, plastic, wood or any other suitable material. These strips 30*a* can be directly attached to the framing or to cavity battens with nails, screws, staples, adhesive or any other fixing means to form the rows of fixing devices on the framing Flat-Backed Cladding Boards The previous embodiments are described in the context of the fixing system and cladded structure when used with weatherboards having a bevel-backed profiles in which the rear surface of the boards have a sloped or angled upper portion (like is shown at 12 in FIG. 1) that abuts the batten or fixing strips or framing such that only a portion of the rear surface of the board contacts the batten or fixing strips or framing and which pivots the front surface of the board at an angle relative to the framing. However, it will be appreciated that the fixing system and cladded structure may be applied to alternative types of board profiles which are flat-backed such that boards are not pivoted relative to the framing Embodiments of a cladded structure formed with the fixing system with flat-backed boards will now be described by way of example with reference to FIGS. 10*a*-11*b*.

Referring to FIGS. 10*a* and 10*b*, an embodiment of the cladded structure 100 with a first alternative-type of cladding boards 128 having a flat-backed profile is shown. The cladded structure is substantially similar to the embodiment previously described with reference to FIGS. 7*a*-7*c*, and like reference numbers represent like or equivalent features or components. Compared with the previous embodiment, the cavity batten or fixing strip 22 comprises modified fixing devices 130 in which there is no underlying wedge-shaped body. Rather, each fixing device 130 comprises only the engagement formation 40 previously described to complement the flat-backed profile of the cladding boards, which is described further below.

Referring to FIG. 10*c*, the first alternative-type of cladding board is defined in cross-section in its longitudinal direction between a front surface 115 and rear surface 111 that extend between upper 105 and lower 107 surfaces. The front surface 115 comprises a main portion 115*a* extending from the lower surface 107 and terminating prior to the top surface 105, and an upper step portion 115*b* (e.g. stepped at right angles) extending between the termination of the main portion and the top surface 105 and which is recessed back from the surface of the main portion 115*a*. The rear surface 111 comprises a main portion 111*a* extending from the upper surface 105 and terminating prior to the lower surface 107, an engagement recess 142 for engaging with a fixing device 130 in a manner previously described and which is located below the main portion 111*a*, and a lower step portion 111*b* (e.g. stepped at right angles) that extends below the engagement recess 142 to the lower surface 107 and which is recessed back from the engagement recess 142. As shown, the engagement recess is provided with an angled upper surface 142*a* that extends into the board from the main portion 111*a* of the rear surface and a back surface 142*b* extending vertically downward. The lower step portion 111*b* is configured to overlap at least partially with the upper step portion 115*b* of another board when installed, as shown in FIG. 10*a*. In this embodiment, grooves 113,114 are provided in each of the step portions 115*b*,111*b* respectively such that when installed they co-operate to form anti-capillary channels. The thickness of the upper 115*b* and lower 111*b* step portions in the overlapping regions are configured to complement each other such that their combined thickness equals the overall thickness of the cladding board. As shown, one or more of the various transitional edges between recesses and portions may be chamfered or bevelled, or alternatively rounded or left at right angles.

FIGS. 11*a* and 11*b* show another embodiment of the cladded structure 200 that is similar to that of FIGS. 10*a* and 10*b*, except with a second alternative-type of flat-backed cladding board 228, but otherwise similar. Referring to FIG. 11*c*, the second alternative-type of flat-backed cladding board 228 is defined in cross-section in its longitudinal direction between a front surface 215 and rear surface 211 that extend between upper 205 and lower 207 surfaces. The front surface 215 comprises a main portion 215*a* extending from the lower surface 207 and terminating prior to the top surface 205, and an upper step portion 215*b* extending between the termination of the main portion and the top surface 205. The upper step portion 215*b* is not stepped at right-angles like in the first alternative-type board of FIG. 10*c*, but rather comprises a curved ramp portion 260*a* extending back into the board from the front surface and which extends into a flat portion 260*b* to form the upper step portion 215*b* that is recessed back from the surface of the main portion 215*a*. The rear surface 211 comprises a main portion 211*a* extending from the upper surface 105 and terminating prior to the lower surface 207, an engagement recess 242 for engaging with a fixing device 130 in a manner previously described and which is located below the main portion 211*a*, and a lower step portion 211*b* that extends below the engagement recess 242 to the lower surface 207 and which is recessed back from the engagement recess 242. As shown, the engagement recess is provided with an angled upper surface 242*a* that extends into the board from the main portion 211*a* of the rear surface and a back surface 242*b* extending vertically downward. The lower step portion 211*b* is configured to overlap at least partially with the upper step portion 215*b* of another board when installed, as shown in FIG. 11*a*. In this embodiment, grooves 213,214 are provided in each of the step portions 215*b*,211*b* respectively such that when installed they co-operate to form anti-capillary channels. The thickness of the upper 215*b* and lower 211*b* step portions in the overlapping region are configured to complement each other such that their combined thickness equals the overall thickness of the cladding board. As shown, one or more of the various transitional edges between recesses and portions may be chamfered or bevelled, or alternatively rounded or left at right angles.

Embodiments Using Second Form of the Fixing Devices—Engagement Tabs

Figure 12A:
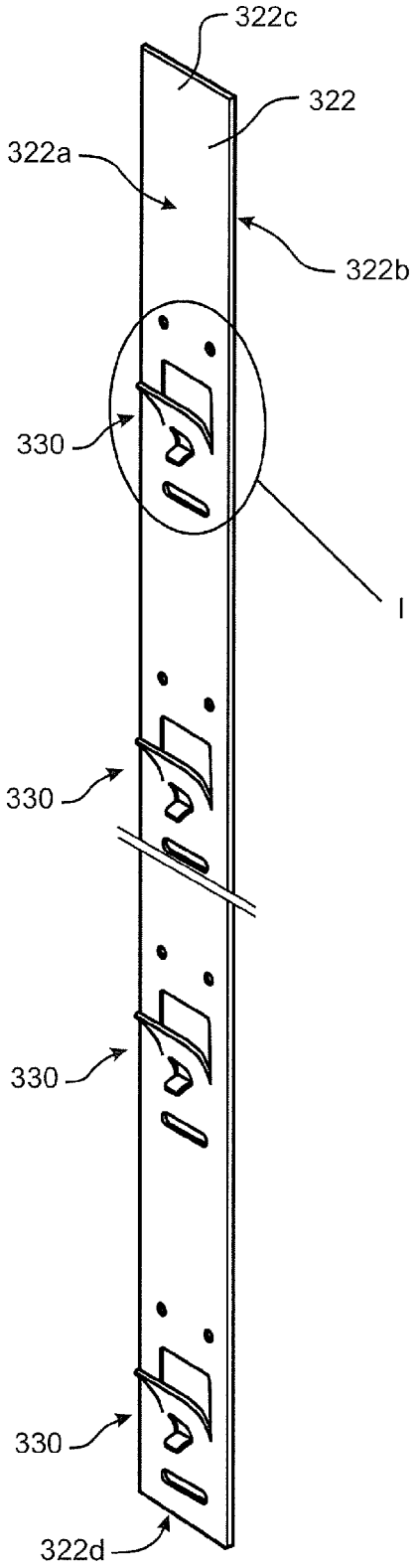
FIG. 12*a* shows a perspective view of a fixing strip comprising a second form of the fixing devices having engagement tabs.
Figure 12B:
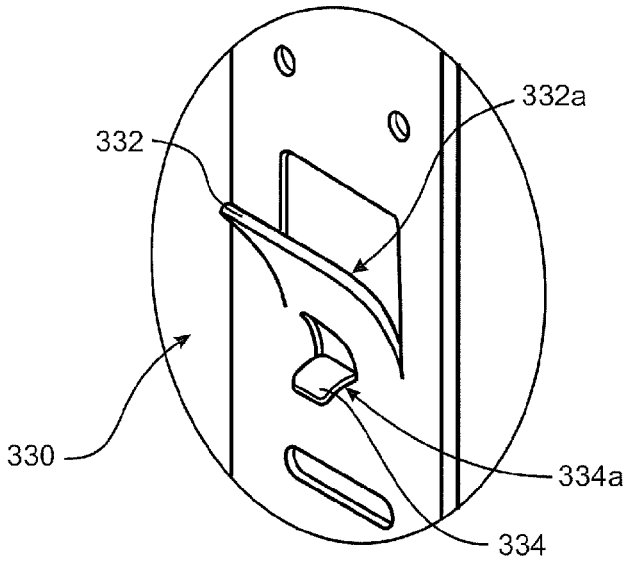
FIG. 12*b* shows a close-up view of section I of FIG. 12*a;*

Embodiments of the cladded structure using a second form of fixing devices having engagement members in the form of engagement tabs will now be described. Referring to FIGS. 12*a* and 12*b*, a fixing strip 322 is shown that is in the form of an elongate strip of material defined by a front face 322*a* and a rear face 322*b* extending between a top end 322*c* and bottom end 322*d* and comprising a series of integral fixing devices 330 spaced apart along the length of the strip, each fixing device comprising an upper engagement tab 332 that is a substantially flat portion of material punched from the strip and which is adjoined to the strip at an intact edge of the tab. The engagement tab is bent about a bending edge (which may be aligned or displaced from the intact edge) so as to extend at an acute angle relative to the front face 322*a* of the strip for engaging with the complementary recess of a cladding board in a holding relationship as will be described further below. For example, the upper surface 332*a* of the engagement tab 332 provides an inclined seat surface upon which a complementary angled surface of the recess of the cladding board sits or rests in a manner similar to that described above for the previous embodiments.

In this embodiment, each fixing device 330 further comprises an associated lower tab 334 situated below its associated engagement tab 334 relative to the top end 322*c* of the strip. In this embodiment, the lower tab 334 is a substantially flat portion of material punched from the strip and which is adjoined to the strip at an intact edge of the tab, the lower tab being bent about a bending edge (which may be aligned or displaced from the intact edge) so as to extend at a predetermined angle relative to the front face of the strip. The angle of the lower tab 334 is greater than the acute angle of the upper engagement tab 332. In this embodiment, the lower tab 334 is smaller than the engagement tab 332 and may extend at a substantially perpendicular angle relative to the front face 322*a* of the strip 322. The underside 334*a* of the lower tab 334 associated with each fixing device 330 provides a protruding surface for forming the retaining gap associated with the fixing device, in co-operation with a section of the upper surface of a lower adjacent cladding board, as will be further explained below with reference to FIGS. 12*c*-13*b*.

It will be appreciated that the tabs 332,334 of the fixing devices are integrally formed from the material of the fixing strip 322 itself, which may for example be metal, steel, aluminium or any other suitable material.

Bevel-Backed Weatherboards

Figure 12C:
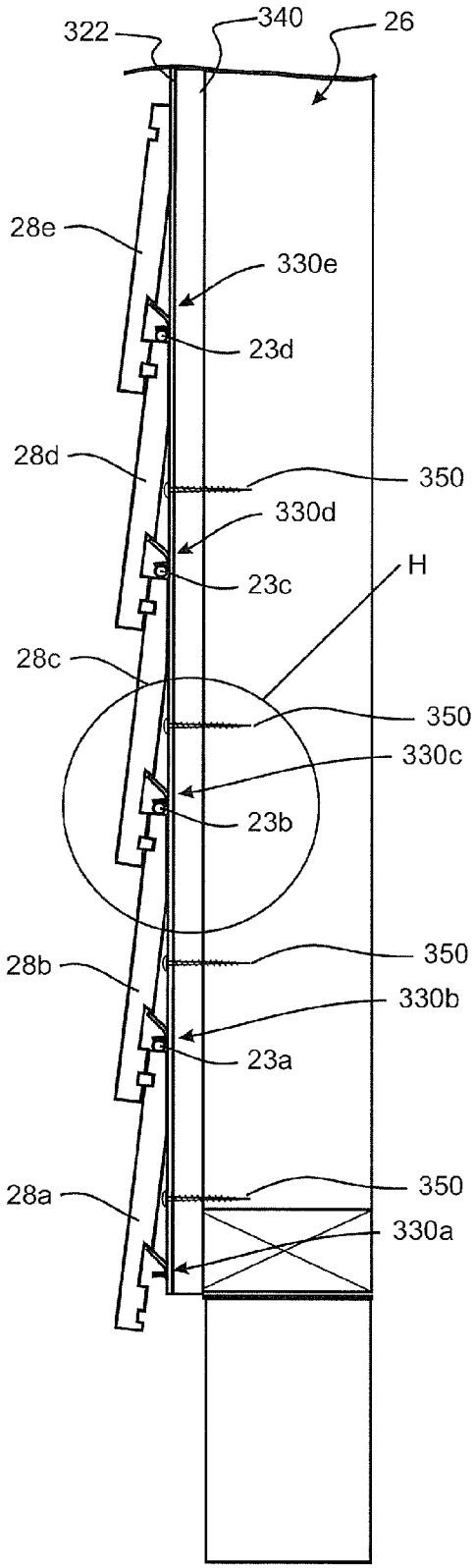
FIG. 12*c* shows an equivalent view of FIG. 7*a* except for a partially cladded structure in which bevel-backed weatherboards are secured to the framing with cavity battens carrying a second form of the fixing devices having engagement tabs as shown in FIGS. 12*a* and 12*b* in accordance with another embodiment of the invention.
Figure 12D:
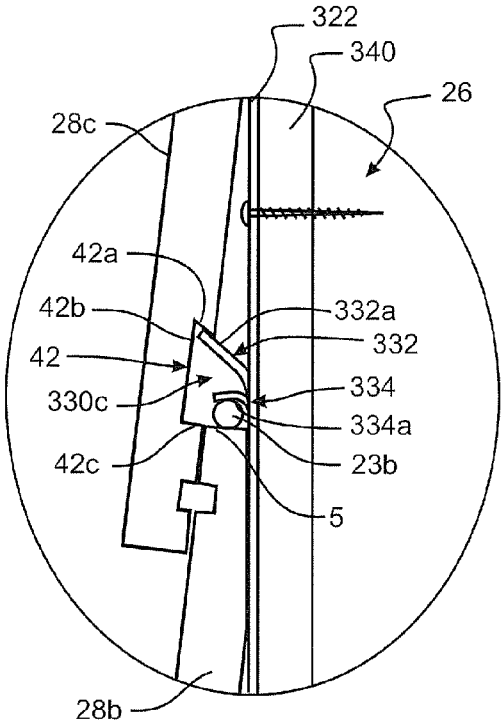
FIG. 12*d* shows a close-up view of section H of FIG. 12*c;*

FIGS. 12*c* and 12*d* show a cladded structure 300 for bevel-backed weatherboards similar to the embodiment described and shown in FIGS. 7*a*-7*c*, except using the fixing strip 332 comprising the second form of fixing devices 330 described above with reference to FIGS. 12*a* and 12*b*. Again, like or equivalent components are shown with like reference numerals. It will be appreciated that the fixing strips 332 may be fixed either directly to the framing 26 or support structure to be clad in a similar way to the cavity battens or fixing strips 22 in FIGS. 7*a*-7*c* or alternatively indirectly fixed to the framing 26 via cavity battens 340 as shown. Fixing of the strip 322 to the cavity batten 340 and framing 26 may be via any suitable form of fixing components, such as screws 350 as shown, nails, or any other fixing means, including adhesives. For example, the fixing devices 330 may be provided on a cavity batten, in a fixing strip, or in individual mountable form as described below with reference to the third form of fixing devices 72 in FIGS. 16*a*-16*c*. It will be appreciated that the same forms and principles of construction of the third form of fixing devices 72 apply to this second form of fixing devices 330.

Referring to FIG. 12*d*, the cladding boards 28 are shown with the same profile of recess 42 as described previously. The upper surface of the engagement tab 332 provides the inclined seat surface 332*a* upon which the complementary angled upper surface 42*a* of the cladding board recess abuts such that the cladding board 28*c* sits or rests upon the engagement tab 332 of its associated fixing device 330*c*. The lower or underside surface 334*a* of the lower protruding tab 334 of the fixing device 330*c* provides the protruding surface that forms the retaining gap in co-operation with a section of the upper surface 5 of cladding board 28*b*. As with the previous embodiments described, a retaining component 23*b* is securely received and retained within its retaining gap in a deformed state so as to exert downward force on lower board 28*b* to hold it in place on its respective row of fixing devices 330*b*. The properties of the retaining components 23 are the same as those described for the previous embodiment. The general operation of the cladded structure and the components are otherwise the same as that described with the previous embodiments. The various component options and alternatives described with regard to the previous embodiments of the cladded structure may also be applied to this embodiment. For example, it will be appreciated that retaining components for the retaining gaps may be of the material-type, mechanical-type, or otherwise, as described for the previous embodiment of the cladded structure.

Flat-Backed Cladding Boards

It will be appreciated that the second form of the fixing devices 330 may also be used with flat-backed cladding boards.

FIGS. 13*a* and 13*b* show an alternative embodiment of the cladded structure 400 with a first alternative-type of cladding board 128 having a flat-backed profile (like that described and shown in FIG. 10*c*). The cladded structure is substantially similar to the embodiment previously described with reference to FIGS. 12*c* and 12*d*, and like reference numbers represent like or equivalent features or components. The primary differences with the previous embodiment is that the fixing strip 322 comprises modified fixing devices 430 in which the upper engagement tabs 432 are shorter in length and the lower tab 434 is displaced further from the engagement tab to complement the different profile of the board 128. As shown in FIG. 13*b*, the rear surface or face of the board is provided with a recess 442 having an angled engagement surface 442*a* that is configured to rest or sit on the complementary inclined seat surface provided by the engagement tab 432 of the fixing device 430 in a similar manner to that described previously.

FIGS. 14*a* and 14*b* show another embodiment of the cladded structure 500 that is similar to that of FIGS. 13*a* and 13*b*, except with a second alternative-type of flat-backed cladding board 228 (like that described and shown in FIG. 11*c*), but otherwise similar.

Embodiments Using Third Form of the Fixing Devices—Bracket-Type

Referring to FIGS. 15*a*-16*c*, other embodiments of the cladded structure 600 will be described that are similar to the previous embodiments but which use fixing devices that have engagement members in the form of or comprising bracket-type components having engagement portions that are shaped and/or configured to engage with a recess in the rear surface of the cladding board. The same reference numerals designate the same components.

Figures 15A, 15B, 15C:
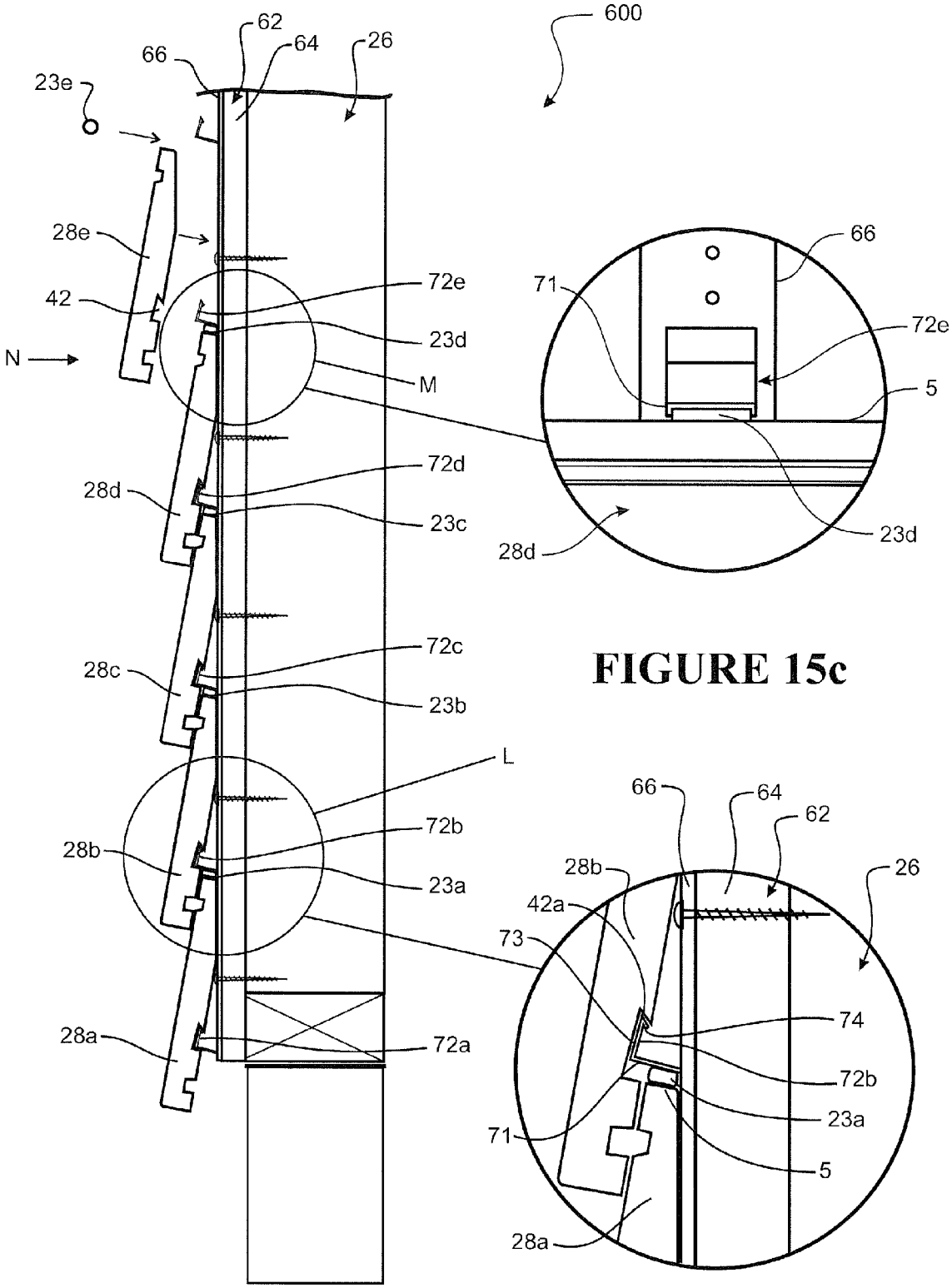
FIG. 15*a* shows an equivalent view to FIG. 7*a* except for a partially cladded structure in which bevel-backed weatherboards are secured to the framing with cavity battens carrying a third form of the fixing devices that are bracket-type components having an engagement portion in accordance with another embodiment of the invention.
FIG. 15*b* shows a close-up view of section L of FIG. 15*a;*
FIG. 15*c* shows a close-up front view of section M of FIG. 15*a* viewed in direction N.

As shown, rows of fixing devices 72*a*-72*e* are provided for supporting respective rows of cladding boards 28*a*-28*e*. FIG. 15*a* shows a partially cladded structure 600 with cladding boards 28*a*-28*d* installed, and the next board 28*e* ready to be installed. The configuration is similar to that described with reference to the embodiment of FIGS. 7*a*-7*c*. The fixing devices 72 engage into the recess provided in and along the rear surface of the cladding boards to support the boards in place on the framing. Again, the cladded structure also comprises a plurality of resiliently deformable retaining components 23*a*-23*d* (shown installed) and 23*e* (yet to be installed) that are located in respective retaining gaps provided between sections of the upper surface of each cladding board and the lower portions or surfaces of the row of fixing devices associated with the next upper adjacent cladding board as previously described. FIG. 15*b* shows a close-up view of the configuration of the fixing device 72*b* for supporting cladding board 28*b* and the retaining component 23*a* located in its retaining gap in a deformed state for exerting a downward force on the upper surface 5 of the lower cladding board 28*a* to hold, lock or retain the board on its respective row of fixing devices 72*a* (not visible in FIG. 15*b*).

FIG. 15*c* shows a front view of a section of the installed cladding board 28*d* and fixing device 72*e* of the upper row of fixing devices for the next adjacent row of cladding boards 28*e*. As shown, the retaining component 23*d* is shown inserted in the retaining gap between the upper surface 5 of the cladding board 28*d* and a lower portion or surface 71 of the fixing device 72*e*. The properties of the retaining components 23 are the same as that previously described for the other embodiments.

Figure 16A:
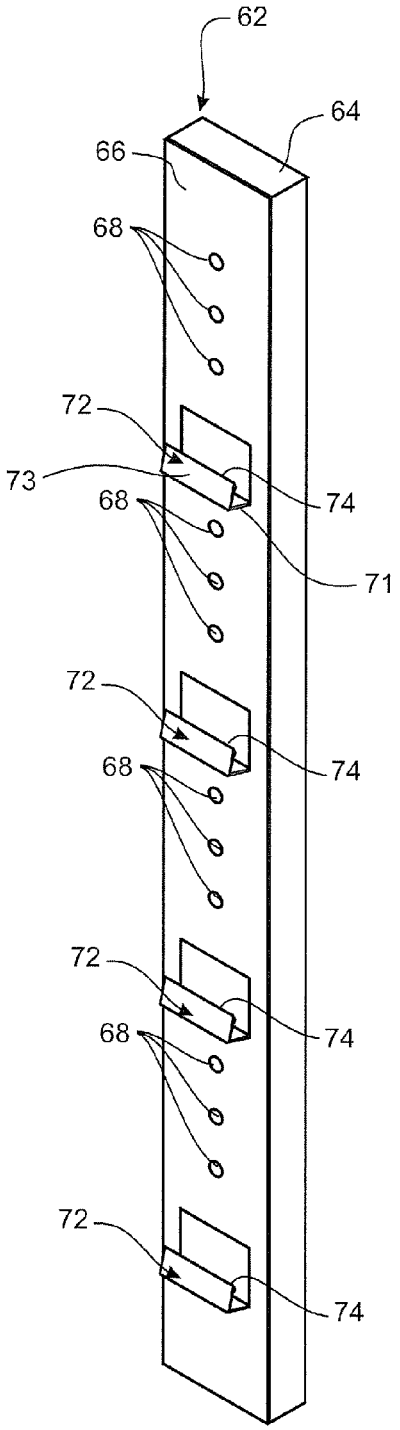
FIG. 16*a* shows a perspective view of a cavity batten comprising the third form of fixing devices as in FIGS. 15*a*-15*c;*
Figure 16B:
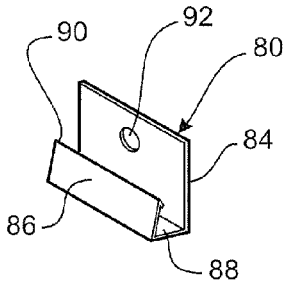
FIG. 16*b* shows a perspective view of the third form of the fixing devices where they are individually formed for mounting directly to a support structure to be clad.
Figure 16C:
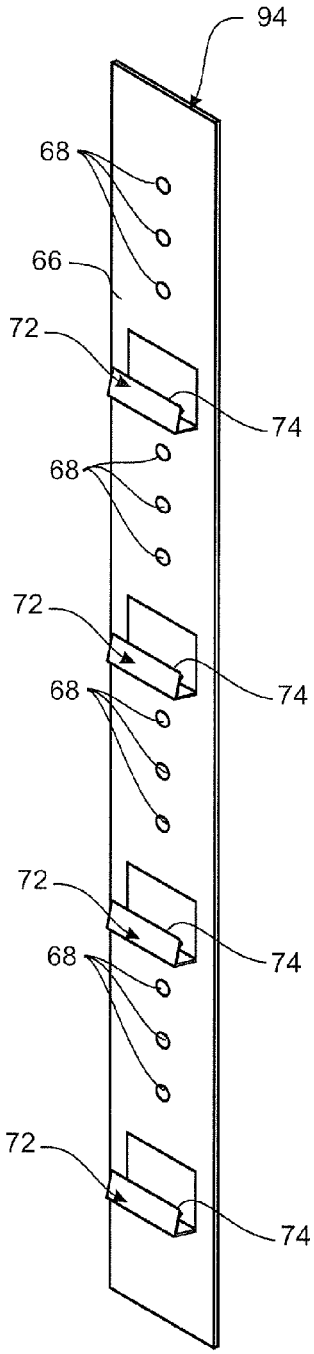
FIG. 16*c* shows a fixing strip comprising the third form of the fixing devices.

As with the other embodiments, the bracket-type fixing devices 72 may be provided in spaced-apart rows on the support structure, for example framing 26 or otherwise, in various forms. FIGS. 16*a*-16*c* show fixing devices 72 provided in a cavity batten form, individually mountable brackets, and in a fixing strip respectively. Each will be explained in further detail below.

Referring to FIG. 16*a*, the cavity battens 62 of the cladded structure 600 comprise an elongate base member 64 on to which is attached a top plate 66. The top plate 66 is provided with a number of connection apertures 68 through which fixing components such as screws 70, nails, or the like may extend to fix the cavity batten 62 to the framing 26 as shown in FIG. 15*a*. It will be appreciated that screws, nails, or other fixing components may extend through these apertures 68 to couple the top plate 66 to the base member 64 or alternatively the top plate may be connected to the base member 64 via adhesives such as glue or the like.

In this form, the top plate 66 is punched along its length to form bracket-type fixing devices 72 that are shaped to engage with complementary recesses 42 in the rear surfaces of cladding boards 28 as shown in FIG. 15*a*. In particular, the bracket-type fixing devices 72 may have a substantially L-shaped cross-sectional profile. For example, the fixing devices 72 may comprise a base portion 71 that is arranged to extend outwardly relative to the batten 62 and an integral engagement portion 73 that extends upwardly from the base portion 71 and which terminates with a hooked-end edge 74 that bends toward the batten. In operation, the hooked-end edge 74 is arranged to provide a seat surface upon which a complementary engagement surface 42*a* of the recess 42 of the cladding board 28 may sit or rest in a hook-like engagement or holding relationship to hold the board in place on the batten and framing, as described with reference to the previous embodiments.

It will be appreciated that the bracket-type fixing devices 72 may be formed in other ways and do not necessarily have to be integrally provided by a single top plate 66. For example, individual bracket-type fixing devices may be individually attached or secured along the length of the base member 64 of the cavity batten 62 at spaced apart intervals. The cavity batten 62 may be formed from wood, plastic, metal or a combination thereof. For example, it may have a wooden base member 64 and a metal top plate 66 having metal integral fixing devices 72 or alternatively the top plate 66 may be plastic. The base member 64 does not necessarily have to be wood and could also be plastic or metal.

In alternative embodiments of the cladding structure 600, the bracket-type fixing devices 72 may be provided on the supported structure or framing 26 without cavity battens.

Referring to FIG. 16*b*, individual fixing devices 80 of the bracket-type are shown. The individual fixing devices 80 may be mounted directly or indirectly onto the support structure with nails, screws, staples, adhesive or any other fixing means to form the rows of fixing devices (with or without cavity battens). In this form, the fixing devices 80 have a substantially U- or J-shaped cross-sectional profile that is formed by shaping or bending a flat metal component. For example, the fixing devices 80 comprise a rear portion 84 and a front engagement portion 86 that are integrally joined at the bottom by a base portion 88 to create a substantially U- or J-shaped bracket. In the preferred form, the front engagement portion 86 terminates with a hooked-end top edge 90 that bends toward rear portion 84. In operation, the hooked edge 90 provides an inclined seat surface upon which a complementary inclined surface 42*a* of the recess of the board sits or rests as previously described in a hook-like engagement or holding relationship. The rear portion 84 is provided with an aperture 92 through which a fixing component, such as a screw, nail, or the like, may extend to secure or attach the fixing device to the support structure to be clad.

Referring to FIG. 16*c*, the bracket-type fixing devices may be formed in integral plates or fixing strips 94. These strips 94 can be directly or indirectly attached to the support structure (with or without cavity battens) with nails, screws, staples, adhesive or any other fixing means to form the rows of fixing devices on the support structure. The strips 94 may be any desired length and may be formed from metal, steel, plastic, wood or any other suitable material. By way of example, the strips 94 may be essentially the same as the top plates 66 described with reference to the cavity batten 62 of FIG. 16*a*.

Method of Installing Cladding Boards to Form the Cladded Structure

Installation of cladding boards utilising a fixing system for forming the cladded structure will now be described with reference to FIG. 6. FIG. 6 employs the fixing devices of the first form with engagement formations, but the same installation method applies to the other forms of fixing devices and embodiments described. Firstly, the installation involves securing rows of spaced-apart fixing devices 30 to the support structure to be clad, which in this case is framing 26. In FIG. 6, the fixing devices 30 are provided on cavity battens 22, although in alternative embodiments they may be fixed to the support structure as individual fixing devices or in fixing strips as previously described. The cavity battens 22 are installed in a vertical orientation at spaced-apart intervals on the framing 26. These intervals can be lengthened or shortened as desired and they do not necessarily have to be uniform across the width (indicated in the direction of arrow W) of the cladding board support structure. The cavity battens 22 are fixed to the support structure 26 such that the fixing devices 30 are aligned with respect to each other to form rows of fixing devices spaced-apart along the height of the support structure (indicated in the direction of arrow H) in the case of a vertical support structure, although the cladded structure may have any orientation. The spacing X between the rows of the fixing devices is preferably calculated based on the dimension of the cladding board 28 profile and desired overlap so as to provide the required retaining gap for receiving the resiliently deformable retaining components as previously described.

Once the rows of fixing devices are installed on the support structure to be clad, installation then involves mounting the cladding boards to the fixing devices such that the boards have an overlapping relationship to each other. For example, a top portion of the lower board should be covered by a lower portion of the next highest adjacent board, with all boards preferably in a parallel configuration with even overlap, although this may be varied in other embodiments.

Typically, the boards 28 are fixed to cavity battens 22 one at a time beginning at the bottom of the framing 26 where the cladding is to start. Typically, the lower-most board is installed first by being engaged against the lower-most row of fixing devices such that a number of the fixing devices of that row engage securely in sections of the complementary recess in the rear face of the board. Once the lower most board or row of boards are mounted in place upon their respective row of fixing devices, a number of resiliently deformable retaining components are then inserted into at least one retaining gap associated with each of the lower most row of cladding boards, but preferably retaining components are inserted into all of the retaining gaps for maximum securement. The retaining components may be inserted, pushed or wedged into the retaining gaps such that they are received and retained securely in a deformed state. In one alternative method, the retaining components may be stretched by pulling at both ends to reduce the cross-sectional size of the middle portion and then inserted into the retaining gaps without the need to apply additional lateral force. The retaining components may be inserted by hand or with the assistance of hand tools or other devices may be used by the installer. For example, the retaining components may be squeezed or wedged into the retaining gaps with a punch and hammer Once the retaining components are installed, the lower most board or row of boards are securely held in place on the support structure. The next adjacent upper board or row of boards is then installed on their respective row of fixing device in a similar manner, again with a number of retaining components being inserted into their respective retaining gaps formed for that row of cladding board. This process continues up the height of the support structure until it is fully clad or covered as desired. In some situations, the top row of boards of the cladded structure may need to be nailed to the framing, but such nailing may be concealed by soffit lining for example.

Removal of the cladding boards for repair, replacement or maintenance involves a reversal of the above process. The retaining components for a particular cladding board should first be removed from their retaining gaps. Once the retaining components for the cladding board have been removed, the cladding board may be released from its row of fixing devices and removed from the cladded structure. Due to the overlap of the cladding boards, the removal process will typically start at the top of the cladded structure moving downward in an opposite order to the initial installation as will be appreciated.

Alternative Embodiments

In the embodiments above, the retaining gaps are formed or defined between lower surfaces provided by sections of the upper surface of the cladding board and upper surfaces provided by the underside surface of protruding components or surfaces that are part of or associated with the fixing devices, for example the lower portion or part of the fixing devices. It will be appreciated that the protruding surface forming the upper surface of each retaining gap may be considered to be part of each fixing device or may alternatively be considered to be its own component dedicated to forming the retaining gap and being associated with its respective fixing device.

It will be appreciated that the fixing devices may be formed from various materials and that there are various alternative complementary shapes of fixing devices and cladding board recesses that could be utilised to engage with each other to hold cladding boards in place. The various forms of the fixing devices described are provided by way of example only.

It will be appreciated that the vertical and horizontal spacing between fixing devices, whether installed via cavity battens or directly to framing, may be varied as desired to accommodate different framing structures, cladding board sizes and the like. Preferably, the vertical spacing intervals between fixing devices is uniform to provide an even overlap of boards up the framing. The horizontal spacing intervals can be varied according to the desired level of structural integrity required.

The fixing system has been described in the context of cladding the framing of a building, but it will be appreciated that the system can also be applied to roofing, fencing, screens, and ceilings, whether the framing is timber or metal. It will also be appreciated that the boards of the cladding system can be installed horizontally, vertically or on an angle.

Various embodiments of the fixing system and cladded structure have been described above with reference to different forms and examples of the primary components, including but not limited to different forms of fixing devices, different cladding board profiles, different methods of mounting the fixing devices, embodiments with and without cavity battens, and different types of retaining components. It will be appreciated that these different types of components and methods of construction are provided by way of example only, and are not exhaustive. It will further be appreciated that the various features and components of the embodiments of the fixing system and cladded structure described may be interchanged or mixed and matched with each other in alternative embodiments of the fixing system and cladded structure. The appreciable range of combinations of the various components to form different alternative embodiments of the fixing system and cladded structure is intended to be included in the scope of the invention.

Summary of benefits and advantages

The following benefits and advantages are offered by at least some of the embodiments of the invention.

The cladded structure employs a substantially concealed fixing system that does not require nails or other fixing components to penetrate through the individual cladding boards, except possibly for the top row of boards in some applications. The cladding boards are held in place on the support structure by the fixing devices engaged in the recess in the rear surface of the cladding boards and by being locked or held in place on the fixing devices via the resiliently deformable retaining components that apply pressure down onto the upper surface of the cladding board to prevent them from being dislodged from their rows of fixing devices. The use of resiliently deformable retaining components to hold the cladding boards on their respective fixing devices provides an advantage in that the boards can be pre-painted prior to installation on the support structure. Additionally, the retaining components are removable or releasable from their retaining gaps to allow for the removal of cladding boards for repair, maintenance or replacement. This is not the case with fixing systems that employ nails that extend through the cladding board which need to be removed, often resulting in cracking of, or damage to, the cladding board during removal of the nailed cladding boards. Expansion and contraction of the cladding boards is also allowed for with the resiliently deformable nature of the retaining components in that they apply continuing pressure to the upper surface of the board despite expansion and contraction of the board or other components which may occur after installation.

It will be appreciated that the cladded structure formed by the substantially concealed fixing system may be employed on its own to entirely clad a support structure, or alternatively it may be used in combination with other conventional fixing systems where some boards are fixed with the concealed fixing system and other boards are fixed with conventional methods, such by nailing.

The foregoing description of the invention includes preferred forms thereof. Modifications may be made thereto without departing from the scope of the invention as defined by the accompanying claims.

The invention claimed is:

1. A cladded structure comprising:

a support structure for cladding;

rows of spaced-apart fixing devices mounted to the support structure such that the fixing devices are spaced apart vertically and horizontally relative to one another, each fixing device comprising an engagement member for engaging with and supporting a cladding board, the engagement member comprising a seat surface that is angled upwardly relative to the horizontal;

rows of partially overlapping cladding boards covering the support structure with each row of cladding boards being supported by a respective row of fixing devices, each cladding board being defined along the length of the board by front and rear surfaces that extend between upper and lower surfaces of the cladding board, wherein adjacent rows of cladding boards overlap such that the front surface of a top portion of each cladding board substantially abuts a rear surface of a lower portion of a cladding board from an upper adjacent row of cladding boards, and a recess being provided in and along the rear surface of each cladding board into which the engagement members of a number of fixing devices of a row engage to support the cladding board on the support structure such that each row of cladding boards is supported by a respective row of fixing devices and each recess of the cladding boards comprises a complementary angled engagement surface that is configured to sit upon the angled seat surfaces of the engagement members of its respective row of fixing devices in a hook-like engagement relationship to support the cladding boards in place on the support structure, and wherein retaining gaps are formed between lower surfaces corresponding to sections of the upper surface of each cladding board and upper surfaces corresponding to lower surfaces of the row of fixing devices supporting the next upper adjacent cladding board; and a plurality of resiliently deformable retaining components arranged to exert a force on the upper surfaces of the cladding boards in a direction toward and to retain the cladding boards in an engaged state with their respective rows of fixing devices, the plurality of resiliently deformable retaining components comprising a retaining component being located in a deformed state in at least one retaining gap associated with each cladding board, each retaining component being oversized relative to its respective retaining gap with respect to a dimension extending between the upper surface and the lower surface of the retaining gap such that it is held under compression in a deformed state within its respective retaining gap so as to generate the said force on the upper surface of its associated cladding board.

2. The cladded structure according to claim 1 wherein the retaining components are material-type retaining components that are members or bodies formed from a material that is resiliently compressible.

3. The cladded structure according to claim 2 wherein each retaining component is formed from a material selected from any one of the following: rubber, silicone, or plastic polymer.

4. The cladded structure according to claim 2 wherein the retaining components have a cross-sectional shape that substantially conforms to the overall cross-sectional shape of the retaining gap when viewed in the direction of the longitudinally extending cladding boards.

5. The cladded structure according to any one of claims 2 wherein the retaining components are elongate and formed from material that is resiliently extendable in length relative to the longitudinal axis of the member such that the average cross-sectional area of the member transverse to the longitudinal axis reduces in size when the member is extended in length by an applied extension force, and which reverts to its original size when at rest with no extension force applied.

6. The cladded structure according to claim 1 wherein the retaining components are mechanical-type retaining components comprising a mechanical structure that is configured to provide resilient deformability.

7. The cladded structure according to claim 6 wherein each retaining component is in the form of a springy assembly comprising upper and lower surfaces that are resiliently compressible from a rest state to a deformed state in which the lower and upper surfaces are closer together than in the rest state, and wherein the springy assembly is biased toward the rest state.

8. The cladded structure according to claim 7 wherein the springy assembly of each mechanical-type retaining component is formed from a plate having one or more bends that form a resiliently springy component.

9. The cladded structure according to claim 7 wherein the springy assembly of each mechanical-type retaining component comprises an upper plate providing the upper surface and a lower plate providing the lower surface that are joined together by a compressible spring member.

10. The cladded structure according to claim 1 wherein each retaining component is an elongate component having a length that is substantially equal to the width of its respective retaining gap in a direction corresponding to the longitudinally extending cladding boards.

11. The cladded structure according to claim 1 wherein each retaining component has a uniform cross-sectional shape along its length.

12. The cladded structure according to claim 1 wherein each retaining gap that is occupied comprises a single retaining component.

13. The cladded structure according to claim 1 wherein each retaining gap that is occupied comprises a plurality of retaining components.

14. A cladded structure according to claim 1 wherein the fixing devices are provided in integral strips that are secured to the support structure, each strip being provided with a number of integral fixing devices uniformly spaced apart along its length.

15. A cladded structure according to claim 1 wherein the fixing devices are individually mounted directly to the support structure in a spaced apart arrangement vertically and horizontally with respect to each other on the support structure to form the rows of fixing devices on the support structure for supporting rows of cladding boards.

16. The cladded structure according to claim 1 wherein the fixing devices are provided on battens that are secured to the support structure, each batten being provided with a number of fixing devices uniformly spaced apart along its length.

17. The cladded structure according to claim 16 wherein in the region of the battens and outside the overlapping region of adjacent cladding boards the rear surfaces and recesses of the rows of partially overlapping cladding boards are shaped to conform and abut with their respective battens and fixing devices in all the regions except at the retaining gaps.

18. The cladded structure according to claim 1 wherein each fixing device has an engagement member that is in the form of an engagement formation that is shaped to provide the seat surface upon which the complementary engagement surface within the recess of a respective cladding board sits.

19. The cladded structure according to claim 18 wherein each fixing device comprises a wedge-shaped body having a wedge-shaped cross-sectional profile defined by a base end from which a rear face and an front face extend, the front face being angled relative to the rear face such that the front and rear faces meet to form a pointed top-end opposite the base end and wherein the engagement formation protrudes from the front face of the wedge-shaped body at or toward the base end of the wedge-shaped body.

20. A cladded structure according to claim 1 wherein each fixing device has an engagement member that comprises an engagement tab that is angled upwardly relative to the horizontal and configured to engage with the recess of a respective cladding board, and wherein the engagement tab comprises the seat surface upon which the complementary engagement surface within the recess of a respective cladding board sits.

21. A cladded structure according to claim 20 wherein the fixing devices are provided in fixing strips that are secured to the support structure, each fixing strip being an elongate strip of material defined by a front face and a rear face extending between a top end and bottom end and comprising a series of integral fixing devices spaced apart along the length of the fixing strip, each fixing device comprising an engagement tab that is a substantially flat portion of material punched from the strip and which is adjoined to the strip at an intact edge of the tab, the engagement tab being bent about a bending edge so as to extend at an acute angle relative to the front face of the strip for engaging with the complementary recess of a cladding board.

22. A cladded structure according to claim 1 wherein each fixing device has an engagement member comprising a bracket-type component having an engagement portion that provides the seat surface on which the complementary engagement surface within the recess of a respective cladding board sits.

23. A cladded structure according to claim 22 wherein the fixing devices are provided in fixing strips that are secured to the support structure, each fixing strip being an elongate strip of material defined by a front face and a rear face extending between a top end and bottom end and comprising a series of integral fixing devices spaced apart along the length of the strip, each bracket-type component of the fixing device comprising a substantially L-shaped cross-sectional profile formed by a base portion that as arranged to extend outwardly relative to the surface of the strip and an engagement portion that extends upwardly from the base portion and which terminates with a hooked-end edge that bends back toward the strip to provide the seat surface.

24. The cladded structure according to claim 1 wherein the complementary angled engagement surface of the recess of each cladding board is an inclined upper engagement surface extending into the board from the rear surface of the cladding board.

25. The cladded structure according to claim 24 wherein the recess of each cladding board has a cross-sectional profile comprising: an inclined upper engagement surface extending upwardly into the board from the rear surface of the cladding board, a back surface extending downwardly from the inclined upper surface, and a lower surface extending back to the rear surface of the board from a back surface of the recess.

26. The cladded structure according to claim 24 wherein the recess of each cladding board has a cross-sectional profile comprising the inclined upper engagement surface extending upwardly into the board from the rear surface of the cladding board and a back surface extending downwardly from the inclined upper engagement surface, and wherein the seat surfaces of the engagement members of the fixing devices are dimensioned to extend into their respective recess from the rear surface of the cladding board to the back surface of the recess such that the entire seat surface engages with the inclined upper engagement surface of the recess.

27. The cladded structure according to claim 24 wherein the recess of each cladding board has a cross-sectional profile comprising the inclined upper engagement surface extending upwardly into the board from the rear surface of the cladding board and a back surface extending downwardly from the inclined upper engagement surface, and each fixing device further comprises a front surface extending downwardly from the seat surface for engaging with the back surface of a respective recess, and wherein the seat surface and front surface of the engagement members of the fixing devices are dimensioned such that the entire seat surface engages with the inclined upper engagement surface of the respective recess and the entire front surface engages with the back surface of the respective recess.

28. A fixing system for securing rows of cladding boards to a support structure in a partially overlapping relationship, each cladding board defined along its length by front and rear surfaces that extend between upper and lower surfaces, the rows of cladding boards partially overlapping such that the front face of a top portion of each cladding board substantially abuts a rear surface of a lower portion of a cladding board from an upper adjacent row of cladding boards, and a recess being provided in and along the rear face of each cladding board, the fixing system comprising:

a plurality of fixing devices that are mountable to the support structure such that they are spaced-apart vertically and horizontally relative to one another and being aligned into rows, each row of fixing devices being arranged to support a cladding board or row of cladding boards and each fixing device having an engagement member that is arranged to engage with a section of the recess of a cladding board to, in co-operation with a number of other fixing devices of that row also engaging with a section of the recess, support the cladding board in place on the support structure, each engagement member comprising a seat surface that is angled upwardly in use relative to the horizontal and each recess of the cladding boards comprising a complementary angled engagement surface that is configured to sit upon the angled seat surfaces of the engagement members of its respective row of fixing devices in a hook-like engagement relationship, the rows of fixing devices being spaced-apart by a distance that forms retaining gaps between lower surfaces corresponding to sections of the upper surface of each supported cladding board and upper surfaces corresponding to lower surfaces of the row of fixing devices supporting the next upper adjacent board; and a plurality of resiliently deformable retaining components arranged to exert a force on the upper surfaces of the cladding boards in a direction toward and to retain the cladding boards in an engaged state with their respective rows of fixing devices, the plurality of resiliently deformable retaining components comprising a retaining component being insertable in a deformed state into at least one of the retaining gaps associated with each supported cladding board, each retaining component being oversized relative to its respective retaining gap with respect to a dimension extending between the upper surface and the lower surface of the retaining gap such that it is held under compression in a deformed state within its respective retaining gap so as to generate the said force on the upper surface of its associated cladding board.

29. A method of fixing rows of cladding boards onto a support structure in a partially overlapping relationship, each board being defined along its length by front and rear surfaces that extend between upper and lower surfaces, the rows of cladding boards partially overlapping such that the front face of a top portion of each cladding board substantially abuts a rear surface of a lower portion of a cladding board from an upper adjacent row of cladding boards, and a recess being provided in and along the rear surface of each cladding board, the method comprising the steps of:

(a) securing rows of spaced-apart fixing devices to the support structure such that they are spaced apart vertically and horizontally relative to one another so as to form retaining gaps between lower surfaces corresponding to sections of the upper surfaces of each cladding board when installed and upper surfaces corresponding to lower surfaces of the row of fixing devices for supporting the next upper adjacent installed cladding board, each row of fixing devices being arranged to support a board or row of boards and each fixing device having an engagement member that is arranged to engage with a section of the recess of a board to, in co-operation with a number of other fixing devices of that row also engaging with a section of the recess, support the cladding board in place on the support structure, each engagement member comprising a seat surface that is angled upwardly in use relative to the horizontal and each recess of the cladding boards comprising a complementary angled engagement surface that is configured to sit upon the angled seat surfaces of the engagement members of its respective row of fixing devices in a hook-like engagement relationship;

(b) engaging a first cladding board or first row of cladding boards with the lower-most row of fixing devices such that the engagement members of a number of fixing devices of that row engage into the recess of the rear surface of the first board or first row of boards to support the board in place on the support structure;

(c) inserting one or more resiliently deformable retaining components into at least one of the retaining gaps associated with the or each supported cladding board of the first row to exert a force on the upper surface of the or each cladding board of the first row in a direction toward and to retain the cladding boards in an engaged state with their respective row of fixing devices, each retaining component being oversized relative to its respective retaining gap with respect to a dimension extending between the upper surface and the lower surface of the retaining gap such that it is held under compression in a deformed state within its respective retaining gap so as to generate the said force on the upper surface of its associated cladding board; and (d) repeating steps (b) and (c) for each next upper adjacent board or row of boards in relation to their respective rows of fixing devices to progressively clad the support structure with boards from the bottom up.

30. A method according to claim 29 wherein step (a) comprises providing a number of battens, each batten having a number of fixing devices uniformly spaced apart along its length, and securing the battens in a spaced apart relationship and in a vertical orientation on the support structure such that the fixing devices of the battens are aligned to form the rows of fixing devices.

31. A method according to claim 29 wherein step (a) comprises securing individual fixing devices directly to the support structure in a spaced apart arrangement vertically and horizontally with respect to each other to form the rows of fixing devices.

32. A method according to claim 29 wherein step (a) comprises providing a number of fixing strips, each fixing strip having a number of integral fixing devices spaced apart along its length, and securing the fixing strips in a spaced apart relationship and in a vertical orientation on the support structure such that the fixing devices of the fixing strips are aligned to form the rows of fixing devices.

* * * * *